US006094206A

United States Patent [19]

Hawkins

[11] Patent Number: 6,094,206

[45] Date of Patent: Jul. 25, 2000

[54] TRANSFERRING OF COLOR SEGMENTS

[75] Inventor: Gilbert A. Hawkins, Mendon, N.Y.

[73] Assignee: Eastman Kodak Company, Rochester, N.Y.

[21] Appl. No.: 08/936,075

[22] Filed: Sep. 23, 1997

[51] Int. Cl.[7] ..... B41J 13/02

[52] U.S. Cl. ..... 346/140.1; 347/43

[58] Field of Search ..... 346/140.1, 146; 347/43, 71

[56] References Cited

U.S. PATENT DOCUMENTS 4,528,575 7/1985 Matsuda et al. ..... 347/71

5,771,810 6/1998 Wolcott ..... 346/140.1

*Primary Examiner*—N. Le

*Assistant Examiner*—Lamson D. Nguyen

*Attorney, Agent, or Firm*—Raymond L. Owens

[57] ABSTRACT

A colorant transfer printhead for viewing or delivering color segments to a receiver is disclosed. The colorant transfer printhead includes a color segment assembly having a plurality of assembly channels each corresponding to a particular color channel, a plurality of color source layers for delivering different colorants to the assembly channels; and the colorant transfer printhead causes the delivered colorants in the assembly channels to be transferred to the receiver.

10 Claims, 15 Drawing Sheets

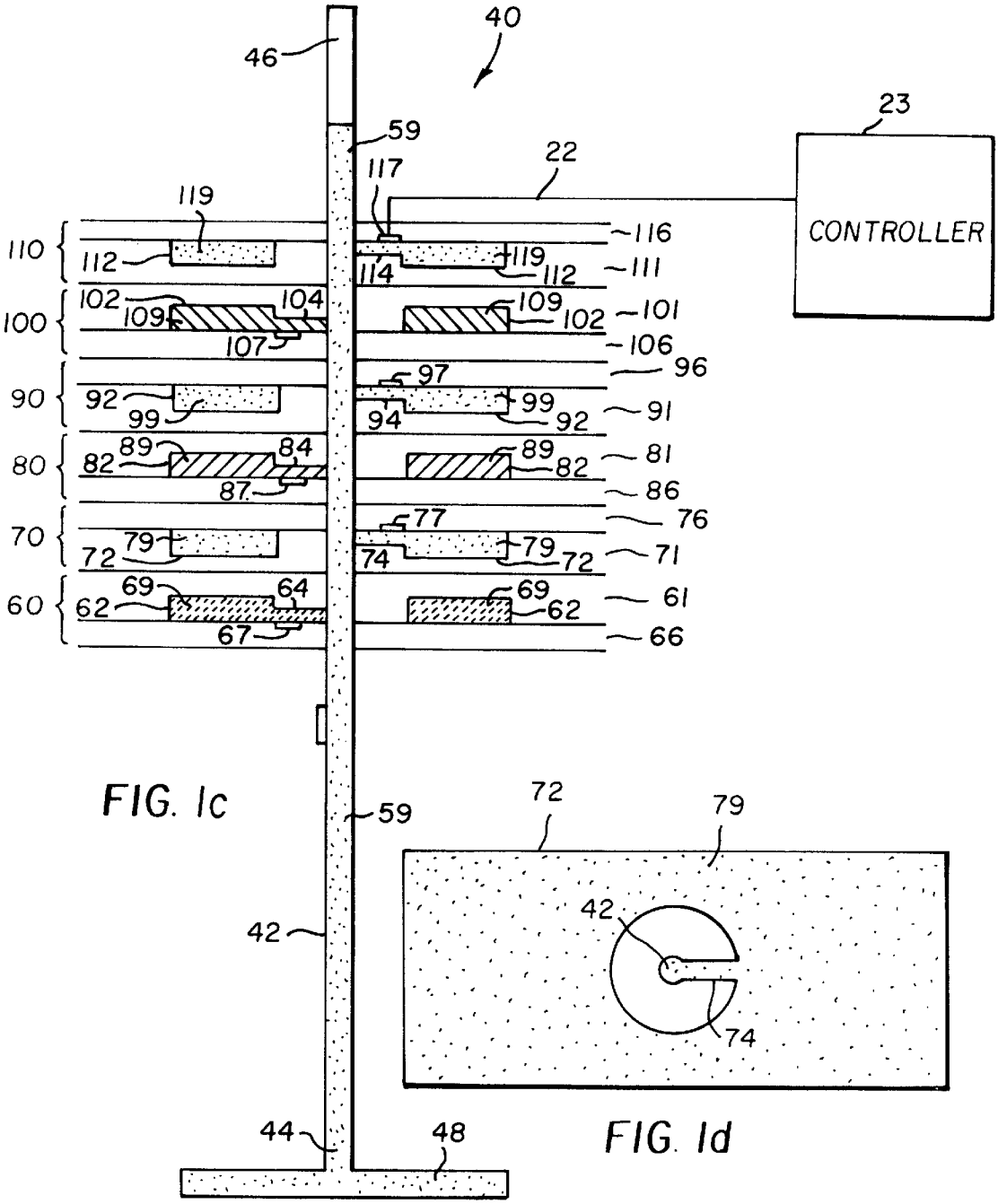
FIG. 1c
FIG. 1d
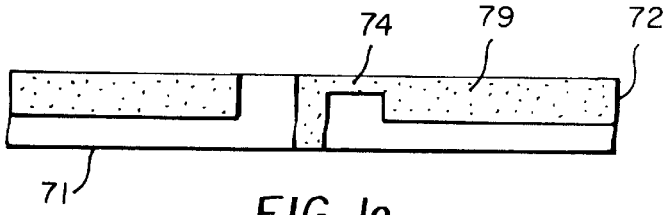
FIG. 1e

TRANSFERRING OF COLOR SEGMENTS

CROSS REFERENCE TO RELATED APPLICATIONS

Reference is made to commonly assigned U.S. patent application Ser. No. 08/882,620 filed Jun. 25, 1997, entitled "Continuous Tone Microfluidic Display and Printing" by Dana Wolcott; U.S. patent application Ser. No. 08/935,402, filed Sep. 23, 1997, entitled "Transferring of Color Segments To a Receiver" by Gilbert A. Hawkins and U.S. patent application Ser. No. 08/935,574, filed Sep. 23, 1997, entitled "Applying Energy in the Transfer of Ink from Ink Color Segments to a Receiver" by Gilbert A. Hawkins, the teachings of which are incorporated herein.

FIELD OF THE INVENTION

The present invention relates to liquid ink printing of continuous tone color images by microfluidic printhead arrays.

BACKGROUND OF THE INVENTION

Inkjet printing is a preferred technology for printing color images. Both continuous inkjet and drop on demand inkjet methods are commonly practiced. In commercial inkjet printers of both types, drops of ink expelled from a printhead traverse a short distance in air to a receiver on which they land, thereby producing a visible image on the receiver. Continuous inkjet printing methods rely on directional control of a stream of continuously produced droplets, while drop on demand methods rely on thermal drop expulsion (as embodied by products from Hewlett Packard Co. and Canon Corp., for example) and on piezo drop expulsion (as embodied by products from Epson Corp., for example). Such inkjet printers suffer from certain drawbacks, for example the difficulty of positioning drops accurately and inexpensively on the receiver. Also, there is generally a need to precisely move or scan the printhead with respect to the receiver on which the droplets land. Mechanical mechanisms to accomplish this motion are costly, require substantial power to operate, and take up space; considerations particularly important for the low cost portable printers. The principally know means of providing continuous tone color reproduction, namely the deposition of multiple drops onto a single image pixel, suffers from an uncertainty in the exact location of the printed pixels because the receiver is typically moving during printing and multiple drops cannot be released simultaneously.

Inkjet printers as currently practiced also suffer from a difficulty of inexpensively achieving continuous tone (grayscale) color reproduction. Such grayscale color reproduction is well known in the art of color printing to be advantageous in producing high quality images. Although some printers control the volume of drops, only drops of a particular color are deposited on the receiver at any one time, and the resulting tone scale is not ideal, because in the case of deposition of two or more ink colors, the first color has dried or been absorbed by the receiver appreciably before drops of the second color are deposited. Also, such methods of continuous tone color reproduction suffer image artifacts because the less dense image pixels, corresponding to smaller volumes of ink, do not occupy the same area on the receiver as the higher density image pixels, corresponding to larger volumes of ink. Failure to print pixels of equal area regardless of image density is known to produce visual artifacts in printed images.

Some solutions to these problems have been proposed in commonly assigned U.S. patent application Ser. No. 08/882,620, filed Jun. 25, 1997 in which ink is deposited on a receiver without the need for the drops to traverse a distance in air to the receiver. According to the contact printhead array disclosed, a substrate is provided with a multiplicity of ink channels and ink in each ink channel is pumped by a corresponding multiplicity of pumps directly to a receiver in contact with the openings of the ink channels at the substrate top surface. Such a contact printhead array comprises a two dimensional array of such ink channels and pumps in order to print all image pixels without the necessity of movement of the receiver with respect to the printhead. Also disclosed are chambers for mixing of inks of different colors prior to deposition of the mixed inks on a receiver, aimed at improving color image quality.

Microfluidic pumping and dispensing of liquid chemical reagents is the subject of three U.S. Pat. Nos. 5,585,069, 5,593,838, and 5,603,351. The system uses an array of micron sized reservoirs, with connecting microchannels and reaction cells etched into a substrate. Electrokinetic pumps comprising electrically activated electrodes within the capillary microchannels provide the propulsive forces to move the liquid reagents within the system. The electrokinetic pump, which is also known as an electroosmotic pump, has been disclosed by Dasgupta et al., see "Electroosmosis: A Reliable Fluid Propulsion System for Flow Injection Analyses", Anal. Chem. 66, pp 1792–1798 (1994). The chemical reagent solutions are pumped from a reservoir, mixed in controlled amounts, and them pumped into a bottom array of reaction cells. The array may be decoupled from the assembly and removed for incubation or analysis. When used as a printing device, the chemical reagent solutions are replaced by dispersions of cyan, magenta, and yellow pigment, and the array of reaction cells may be considered a viewable display of picture elements, or pixels, comprising mixtures of pigments having the hue of the pixel in the original scene. When contacted with paper, the capillary force of the paper fibers pulls the dye from the cells and holds it in the paper, thus producing a paper print, or photograph, of the original scene. One problem with this kind of printer is the rendering of an accurate tone scale. The problem comes about because the capillary force of the paper fibers remove all the pigment solution from the cell, draining it empty. If, for example, a yellow pixel is being printed, the density of the image will be fully yellow. However, in some scenes, a light, or pale yellow is the original scene color. One way to solve this problem might be to stock and pump a number of yellow pigments ranging from very light to dark yellow. Another way to solve the tone scale problem is to print a very small dot of dark yellow and leave white paper surrounding the dot. The human eye will integrate the white and the small dot of dark yellow leading to an impression of light yellow, provided the dot is small enough. This is the principle upon which the art of color halftone lithographic printing rests. It is sometimes referred to as area modulation of tone scale. However, in order to provide a full tone scale of colors, a high resolution printer is required, with many more dots per inch than would be required if the colors could be printed at different densities. Another solution to the tone scale problem has been provided in the area of ink jet printers, as described in U.S. Pat. No. 5,606,351, by Gilbert A. Hawkins, hereby incorporated by reference. In an ink jet printer, the drop size is determined primarily by the surface tension of the ink and the size of the orifice from which the drop is ejected. The ink jet printer thus has a similar problem with rendition of tone scale. The Hawkins patent overcomes the problem by premixing the colored ink with a colorless ink in the correct proportions to produce a drop of ink of the correct intensity to render tone scale. However, ink jet printers require a relatively high level of power to function, and they tend to be slow since only a few pixels are printed at a time (serial printing), in comparison to the microfluidic printer in which all the pixels are printed simultaneously (parallel printing). Also, displays for viewing the image before printing, i.e. LCDs, CRTs, require cost and power that make incorporating them in a portable device impractical.

Such contact printhead arrays are however difficult to fabricate inexpensively due to the size and complexity of the ink channels, pumps, and mixing chambers, particularly for the printing of high quality images with closely spaced pixels, for examples pixels spaced more closely than about 100 microns. As is well known in the art, there is a need for more closely spaced pixels. High quality images are typically printed in the range of from 300 to 2400 dots per inch, the commonly used measure of the density of image pixels, corresponding to pixel spacings of from 80 to 10 microns. Also, the degree of mixing of fluids in mixing chambers is subject to variations due to the time of residence of fluids in the chambers, the order and timing of the combination of the fluids, as is well know in the art of microfluidic mixing, and is disadvantageous for the consistent reproduction of color hue and saturation.

SUMMARY OF THE INVENTION

It is an object of the present invention to form color segments and to effectively transfer such color segments to a receiver.

It is another object of the present invention to form color segments which can be viewed since they correspond to an image.

It is a still further object of the present invention to provide a method and apparatus which solves the prior art problems associated with color inkjet printing. In particular it is the object to provide a simple and inexpensive way of printing high quality color images using low power.

These objects are achieved in a colorant transfer printhead for viewing or delivering color segments to a receiver, a color segment assembly comprising:

(a) means defining a plurality of assembly channels each corresponding to a particular color channel, (b) a plurality of color source layers for delivering different colorants to the assembly channels; and (c) means for causing the delivered colorants in the assembly channels to be transferred to the receiver.

A feature of the present invention is that color segments are formed of colorants such as ink that can be readily viewed or transferred to a receiver.

Another feature of the present invention is that it provides a linear array of color channels which contain color segments for transfer to a receiver.

Another feature of the present invention is that it provides a means for transferring color segments to a receiver without requiring a two-dimensional array of microfluidic pumps.

It is advantageous that such an array may be printed onto a receiver in a manner providing continuous tone color images.

BRIEF DESCRIPTION OF THE DRAWINGS

FIG. 1*c* is a schematic perspective of the color segment assembly unit shown in FIG. 1*b;*

FIG. 1*d* and FIG. 1*e* are respectively top and side views of one color source layer shown in FIG. 1*c;*

DETAILED DESCRIPTION OF THE PREFERRED EMBODIMENTS

Figure 1A:
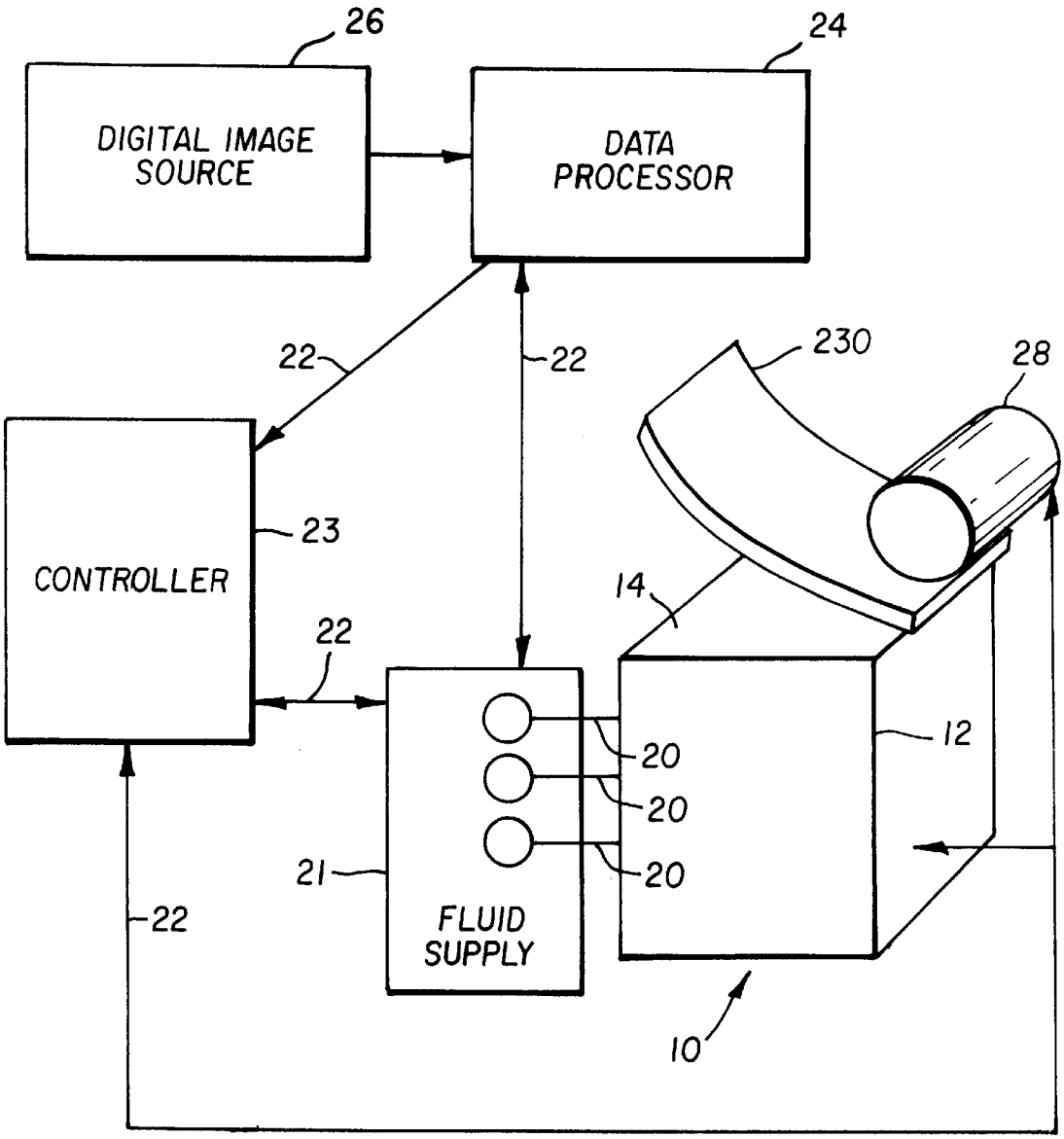
FIG. 1*a* is a block diagram showing apparatus which includes a colorant transfer printhead in accordance with the present invention.

FIG. 1*a* shows a system for displaying and printing images using a colorant transfer printhead 10 connected by fluid supply channels 20 to a fluid supply 21 and connected electrically by electrical interconnects 22 to a controller 23. Controller 23 and fluid supply 21 are connected electrically, by additional electrical interconnects 22, to a data processor 24 which is connected electrically to a digital image source 26. Colorant transfer printhead 10 to be described, comprises a substrate 12 and a substrate top surface 14, and functions to provide a viewable image and/or a printable image on substrate top surface 14 by means to be described of manipulating inks and other fluids to positions on substrate top surface 14 using information provided by controller 23. Controller 23 is connected electrically to a receiver positioning device 28 which can mechanically position a receiver 230 directly above or in contact with colorant transfer printhead 10. In accordance with the method of operation of the present invention, digital data from digital image source 26, for example a computer, a digital camera, or a disk drive, is transferred to data processor 24 which formats the digital data in a manner which permits color hue and intensity to be produced by colorant transfer printhead 10 to be described. For example, data processor 24 may calculate the required time of operation of parts internal to colorant transfer printhead 10 such as pumps, to be described, so that accurate color hue and intensity can be produced for viewing or for printing. To accomplish such calculations, data processor 24 may use information provided by fluid supply 21, for example information of the colors and densities of inks in fluid supply 21, and receives such information through electrical interconnects 22. The double headed arrows on electrical interconnects 22 in FIG. 1*a* indicate that data can flow in either direction, while a single arrow indicated date flow is primarily in a single direction. Controller 23 converts formatted data from data processor 24 into electrical signals that control the operation of colorant transfer printhead 10, to be described, and receiver positioning device 28, which positions receiver 230 directly above or on colorant transfer printhead 10 when printing is desired or positions receiver 230 away from colorant transfer printhead 10 when it is desired to view colorant transfer printhead 10. In a preferred method of operation, colorant transfer printhead 10 provides a viewable image corresponding to the image provided by digital image source 26. In another preferred method of operation, colorant transfer printhead 10 provides an image corresponding to the image provided by digital image source 26 which can be printed. In another preferred method of operation, colorant transfer printhead 10 provides an image corresponding to the image provided by digital image source 26 which can be first viewed and then printed.

Figure 1B:
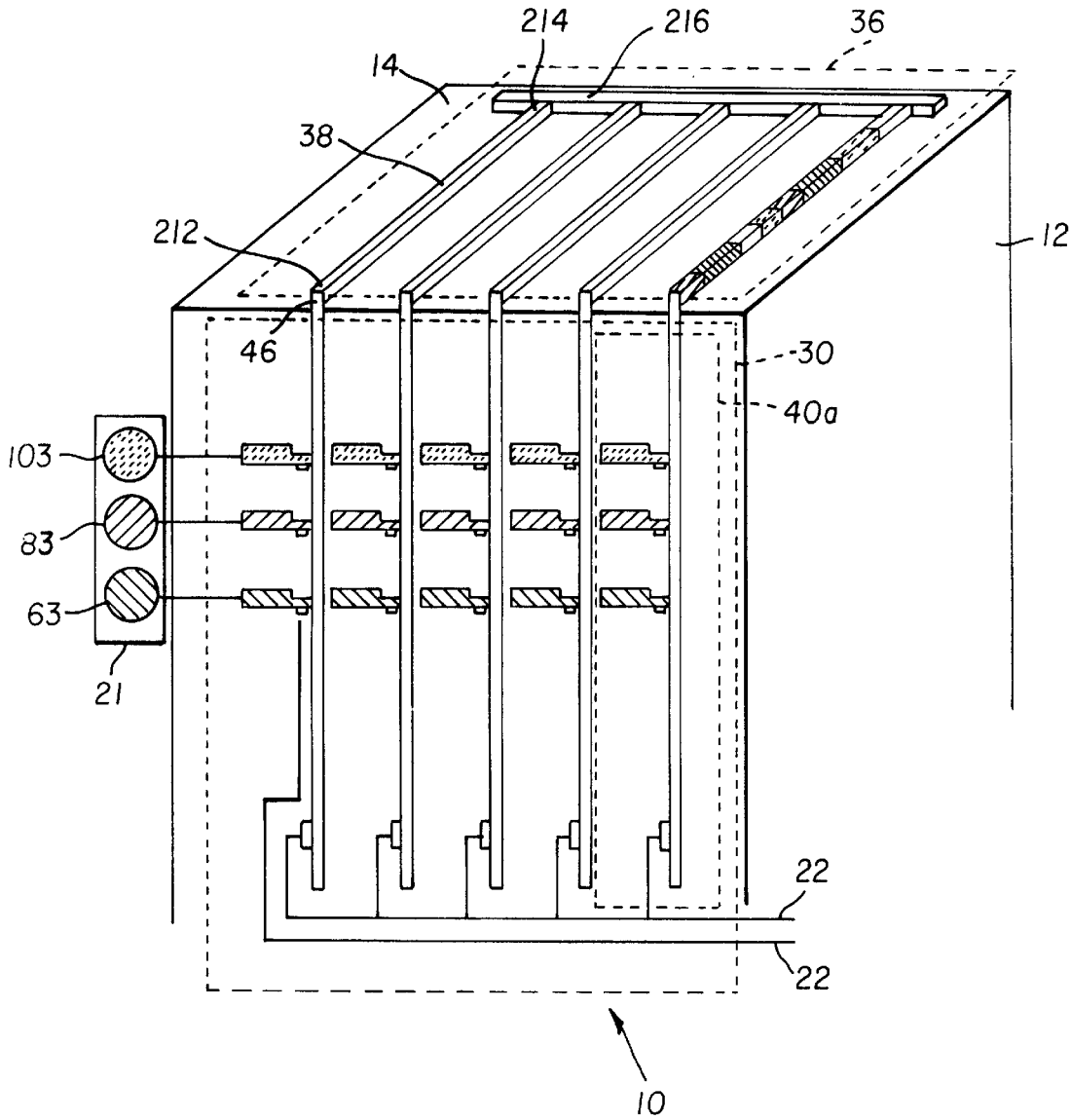
FIG. 1*b* is a schematic perspective of a preferred colorant transfer printhead of FIG. 1*a;*

In accordance with the present invention, colorant transfer printhead 10, shown in FIG. 1*b*, is comprised of a color segment assembly array 30, located along one side of substrate 12, and a color channel array 36, located on substrate top surface 14. As will be described, color segment assembly array 30 comprises a plurality of layers whose geometry and composition differ and which contain elements essential to the operation of colorant transfer printhead 10. In FIG. 1*b*, only some parts of color segment assembly array 30 are shown for simplicity. (FIG. 1*c* contains a detailed drawing parts of color segment assembly array 30.) Likewise, color channel array 36 comprises a plurality of layers to be described whose geometry and composition differ in ways essential to the operation of colorant transfer printhead 10. The construction and operation of color segment assembly array 30 is first described, because in printing images, the color segment assembly array 30 performs functions prior to those performed by color channel array 36.

As shown in FIG. 1*c*, the color segment assembly array 30 comprises a plurality of color segment assembly units 40 aligned side by side, in the preferred embodiment, so that a linear array of color segment assembly units 40 is provided near the side of substrate 12 (FIG. 1*b*). Each color segment assembly unit 40 is constructed by forming an assembly channel 42 by drilling or etching through substrate 12. Typically, the cross-section of assembly channel 42 is circular, with a diameter in the range of from 5 to 100 microns. Preferably, substrate 12 is silicon or is a silicon oxide glass so that the drilling can be accomplished by the steps of photolithographic masking and reactive ion etching, as is well known in the art of integrated circuit processing. Assembly channel 42 has a top and bottom end, respectively assembly channel top 46 and assembly channel bottom 44. Assembly channel top 46 is connected to portions of color channel array 36 (FIG. 1*b*), and assembly channel bottom 44 is connected to a carrier fluid reservoir 48 which provides a source of a carrier fluid 59, preferably a clear fluid, to assembly channel 42. Carrier fluid pump 57 can be activated by controller 23 through electrical interconnects 22 (not shown) in order to pump carrier fluid 59 upwards or downwards along assembly channel 42. The design of first color pump 57 is preferably such that fluid is substantially prevented from flowing in either direction unless first color pump 57 is activated. Microfluidic pumps are well known in the art and can be fabricated by micromachining techniques using equipment and processes commonly employed in the manufacture of integrated circuits. For example, fabrication of electrohydrodynamic pumps is reported by A. Richter, A. Plettner, K. A. Hofmann and H. Sandmaier in Sensors and Actuators A, 29(1991) pp 159–168, and fabrication of electroosmotic pumps is described by P. K. Dasgupta and Shaorong Liu in Ana. Chem. 1994, 66, pp 1792–1798, whose teaching are incorporated by reference herein. Such pumps are activated by application of voltages across electrodes. They may be localized to extend over only a very small region of the channel carrying the fluid to be pumped or they may be configured to occupy a larger portion or all of the channel or channels carrying the fluid to be pumped. Other types of pumps, for example piezoelectric pumps, are also well known in the art and can be used to pump fluids in accordance with this invention. It is to be understood that although the schematic representation of microfluidic pumps shown in FIGS. 1*b* through FIG. 4*h* and discussed in the entirety of the present document shows the pumps occupying only a small portion of the channels along which fluids are to be pumped, in all cases it is within the scope and spirit of this invention that the pumps can be of the types which occupy any or all of the channels along which fluids are pumped.

As shown in FIG. 1*c*, color source layers capable of injecting inks of predetermined colors into assembly channel 42 include first color source layer 60, second color source layer 80, and third color source layer 100. First color source layer 60 is made of two layers, shown as horizontal layers in FIG. 1*c*, specifically a first color reservoir layer 61 and a first color capping layer 66, which layers are bonded, for example by an epoxy bond, after each has been processed to have internal structure essential to operation of the present invention.

The essential features of first color reservoir layer 61 are a first color reservoir 62 which is provided by etching a depression into first color reservoir layer 61 to a predetermined depth and a first color metering region 64 provided by similarly etching a depression into first color reservoir layer 61 but to a lesser depth. First color reservoir layer 61 and first color metering region 64 are typically filled with first color ink 69, so that first color ink 69 can be pumped into assembly channel 42 when desired by a first color pump 67 when the pump is activated controller 23 through electrical interconnects 22 (not shown). As shown schematically in FIG. 1*b*, the first color reservoir 62 is connected to a first color external supply 63 to replenish first color ink 69 when it is pumped into assembly channel 42. The portion of the first color reservoir 62 to the right of assembly channel 42 is not shown in FIG. 1*b* for simplicity. As shown in FIG. 1*c*, a portion of the assembly channel 42 extends through the first color reservoir layer 61.

The first color capping layer 66, shown in FIG. 1*c*, is attached, for example by epoxy cement, to the bottom of first color reservoir layer 61, thereby serving to form one side of the first color reservoir 62. The first color capping layer 66 in addition contains a first color pump which can be activated by controller 23 through electrical interconnects 22 when it is desired to pump first color ink 69 into assembly channel 42. The design of first color pump 67 is preferably such that fluid is substantially prevented from flowing in either direction unless first color pump 67 is activated. Such pumps are well know in the art and can be fabricated for example by two conductive electrodes to form a microkinetic pump. Microkinetic pumps are activated by application of a voltage across their electrodes. Other types of pumps are well known in the art of fluid mechanics and may also serve to pump fluids in accordance with the present invention. A portion of assembly channel 42 extends through the first color capping layer 66, as shown in FIG. 1*c*, so that a portion of assembly channel 42 passes through the entire first color source layer 60.

Also as shown in FIG. 1*c* is a first drain layer 70 comprising a first drain reservoir layer 71 and a first drain capping layer 76, attached together, for by an epoxy bond, in a manner similar to that by which first color reservoir layer 61 and first color capping layer 66 are attached to form first color source layer 60. The structure of first drain layer 70 mirrors that of first color source layer 60 and the parts are similarly named and numbered, except that the first drain layer 70 is flipped top to bottom and left to right relative to first color source layer 60.

The first drain reservoir layer 71 includes a first drain reservoir 72 which is provided by etching a depression into first drain reservoir layer 71 to a predetermined depth and a first drain metering region 74 which is provided by similarly etching a depression into first drain reservoir layer 71, but to a lesser depth. A portion of assembly channel 42 extends through the first drain reservoir layer 71. As shown in FIG. 2, first drain reservoir 72 and first drain metering region 74 are typically filled with fluid (a first collected fluid 79) pumped from assembly channel 42 by a first drain pump 77 when first drain pump 77 is activated by controller 23. The first drain reservoir 72 is connected to a first external drain 73 (not shown) in a manner similar to that shown in FIG. 2*b* for connection of first color external supply 63 to first color reservoir 62. Fluid pumped from assembly channel 42 by first drain pump 77 flows into first external drain 73 if the volume of such fluid exceeds the volume of first drain reservoir 72. The structure of first drain pump 77 mirrors that of first color pump 67 except that first drain pump 77 is made so that fluid is pumped from assembly channel 42 when the pump is activated rather than into assembly channel 42.

First drain capping layer 76 is shown in FIG. 1*c* as bonded, for example by epoxy cement, to the top of the first drain reservoir layer 71, serving to form one side of the first drain reservoir 72. First drain capping layer 76 contains first drain pump 77 which may be activated by controller 23 when it is desired to pump fluid from assembly channel 42 through first drain metering region 74. First drain pump 77 is preferably designed such that fluid is substantially prevented from flowing in either direction unless first drain pump 77 is activated. A portion of assembly channel 42 extends through the first drain layer 70, as shown in FIG. 1*c*, so that a portion of assembly channel 42 passes through the entire first drain layer 70.

FIGS. 1*d* and 1*e* show a top view and cross-sectional view respectively of first drain reservoir layer 71, illustrating the etch depths of first drain reservoir 72 and first drain metering region 74.

As will be described, the pair of layers comprising first color source layer 60 and first drain layer 70 operate together to provide a means of exchanging any fluid or a portion of the fluid which may be in assembly channel 42 at a location between first color metering region 64 and first drain metering region 74 with first color ink 69 without altering the position of fluid in assembly channel 42 at any other location.

In a similar manner and with similar numbering and naming conventions, pairs of layers consisting of a second color source layer 80 and a second drain layer 90 and of a third color source layer 100 and a third drain layer 110 are located above first color source layer 60 and first drain layer 70. Thereby a means is provided by which fluid or a portion of fluid which may be in assembly channel 42 at a location between a second color metering region 84 and a second drain metering region 94 may be exchanged with a second color ink 89 without altering the position of fluid in assembly channel 42 at any other location and by which any fluid or a portion of the fluid which may be in assembly channel 42 at a location between a third color metering region 104 and a third drain metering region 114 may be exchanged with a third color ink 109 without altering the position of fluid in assembly channel 42 at any other location, as will be described.

All parts within the pairs of layers consisting of second color source layer 80 and second drain layer 90 and of third color source layer 100 and third drain layer 110 mirror those of first color source layer 60 and first drain layer 70. The parts are similarly named and numbered except that the numbers are incremented by 20 for parts within second color source layer 80 in comparison with parts within first color source layer 60 and again by 20 for parts within third color source layer 100 in comparison with parts within second color source layer 80.

Second color source layer 80 is comprised of a second color reservoir layer 81 and a second color capping layer 86. The essential features of second color reservoir layer 81 are a second color reservoir 82 which is provided by etching a depression into second color reservoir layer 81 to a predetermined depth and a second color metering region 84 provided by similarly etching a depression into second color reservoir layer 81 but to a lesser depth. Second color reservoir layer 81 and second color metering region 84 are typically filled with a second color ink 89 which can be pumped into assembly channel 42 when desired by a second color pump 87 when the pump is activated by controller 23 through electrical interconnects 22 (shown only for the topmost pump, third drain pump 117 in FIG. 1*c*). As shown schematically in FIG. 1*b*, the second color reservoir 82 is connected to a second color external supply 83 to replenish second color ink 89 when it is pumped into assembly channel 42. The portion of the second color reservoir 82 to the right of assembly channel 42 is not shown in FIG. 1*b* for simplicity. As shown in FIG. 1*c*, a portion of the assembly channel 42 extends through the second color reservoir layer 81.

The second color capping layer 86, shown in FIG. 1*c*, is attached, for example by epoxy cement, to the bottom of second color reservoir layer 81, thereby serving to form one side of the second color reservoir 82. The second color capping layer 86 in addition contains a second color pump 87 which can be activated by controller 23 through electrical interconnects 22 when it is desired to pump second color ink 89 into assembly channel 42. The design of second color pump 87 is such that fluid is substantially prevented from flowing in either direction unless second color pump 87 is activated. A portion of assembly channel 42 extends through the second color capping layer 86, as shown in FIG. 1*c*, so that a portion of assembly channel 42 passes through the entire second color source layer 80.

Also as shown in FIG. 1*c* is a second drain layer 90 comprising a second drain reservoir layer 91 and a second drain capping layer 96, attached together, for by an epoxy bond, in a manner similar to that by which second color reservoir layer 81 and second color capping layer 86 are attached to form second color source layer 80. The structure of second drain layer 90 mirrors that of second color source layer 80 and the parts are similarly named and numbered, except that the second drain layer 90 is flipped top to bottom and left to right relative to second color source layer 80.

The second drain reservoir layer 91 includes a second drain reservoir 92 which is provided by etching a depression into second drain reservoir layer 91 to a predetermined depth and a second drain metering region 94 which is provided by similarly etching a depression into second drain reservoir layer 91, but to a lesser depth. A portion of assembly channel 42 extends through the second drain reservoir layer 91. As shown in FIG. 2, second drain reservoir 92 and second drain metering region 94 are typically filled with fluid (a second collected fluid 99) pumped from assembly channel 42 when second drain pump 97 is activated by controller 23. The second drain reservoir 92 is connected to a second external drain 93 (not shown) in a manner similar to that shown in FIG. 2*b* for connection of second color external supply 83 to second color reservoir 82. Fluid pumped from assembly channel 42 by second drain pump 97 flows into second external drain 93 if the volume of such fluid exceeds the volume of second drain reservoir 92. The structure of second drain pump 97 mirrors that of second color pump 87 except that second drain pump 97 is made so that fluid is pumped from assembly channel 42 when the pump is activated rather than into assembly channel 42.

Second drain capping layer 96 is shown in FIG. 1*c* as bonded, for example by epoxy cement, to the top of the second drain reservoir layer 91, serving to form one side of the second drain reservoir 92. Second drain capping layer 96 contains second drain pump 97 which may be activated by controller 23 when it is desired to pump fluid from assembly channel 42 through second drain metering region 94. Second drain pump 97 is preferably designed such that fluid is substantially prevented from flowing in either direction unless second drain pump 97 is activated. A portion of assembly channel 42 extends through the second drain capping layer 96, as shown in FIG. 1*c*, so that a portion of assembly channel 42 passes through the entire second drain layer 90.

Third color source layer 100 is comprised of a third color reservoir layer 101 and a third color capping layer 106. The essential features of third color reservoir layer 101 are a third color reservoir 102 which is provided by etching a depression into third color reservoir layer 101 to a predetermined depth and a third color metering region 104 provided by similarly etching a depression into third color reservoir layer 101 but to a lesser depth. Third color reservoir layer 101 and third color metering region 104 are typically filled with a third color ink 109 which can be pumped into assembly channel 42 when desired by a third color pump 107 when the pump is activated by controller 23 through electrical interconnects 22 (shown only for the topmost pump, third drain pump 117 in FIG. 1*c*). As shown schematically in FIG. 1*b*, the third color reservoir 102 is connected to a third color external supply 103 to replenish third color ink 109 when it is pumped into assembly channel 42. The portion of the third color reservoir 102 to the right of assembly channel 42 is not shown in FIG. 1*b* for simplicity. As shown in FIG. 1*c*, a portion of the assembly channel 42 extends through the third color reservoir layer 101.

The third color capping layer 106, shown in FIG. 1*c*, is attached, for example by epoxy cement, to the bottom of third color reservoir layer 101, thereby serving to form one side of the third color reservoir 102. The third color capping layer 106 in addition contains a third color pump 107 which can be activated by controller 23 through electrical interconnects 22 when it is desired to pump third color ink 109 into assembly channel 42. The design of third color pump 107 is such that fluid is substantially prevented from flowing in either direction unless third color pump 107 is activated. A portion of assembly channel 42 extends through the third color capping layer 106, as shown in FIG. 1*c*, so that a portion of assembly channel 42 passes through the entire third color source layer 100.

Also as shown in FIG. 1*c* is a third drain layer 110 comprising a third drain reservoir layer 111 and a third drain capping layer 116, attached together, for by an epoxy bond, in a manner similar to that by which third color reservoir layer 101 and third color capping layer 106 are attached to form third color source layer 100. The structure of third drain layer 110 mirrors that of third color source layer 100 and the parts are similarly named and numbered, except that the third drain layer 110 is flipped top to bottom and left to right relative to third color source layer 100.

The third drain reservoir layer 111 includes a third drain reservoir 112 which is provided by etching a depression into third drain reservoir layer 111 to a predetermined depth and a third drain metering region 114 which is provided by similarly etching a depression into third drain reservoir layer 111, but to a lesser depth. A portion of assembly channel 42 extends through the third drain reservoir layer 111. As shown in FIG. 2, third drain reservoir 112 and third drain metering region 114 are typically filled with fluid (a third collected fluid 119) pumped from assembly channel when third drain pump 117 is activated by controller 23. The third drain reservoir 112 is connected to a third external drain 113 (not shown) in a manner similar to that shown in FIG. 2*b* for connection of third color external supply 103 to third color reservoir 102. Third collected fluid 119 pumped from assembly channel 42 by third drain pump 117 flows into third external drain 113 if the volume of such fluid exceeds the volume of third drain reservoir 112. The structure of third drain pump 117 mirrors that of third color pump 107 except that third drain pump 117 is made so that fluid is pumped from assembly channel 42 when the pump is activated rather than into assembly channel 42.

Third drain capping layer 116 is shown in FIG. 1*c* as bonded, for example by epoxy cement, to the top of the third drain reservoir layer 111, serving to form one side of the third drain reservoir 112. Third drain capping layer 116 contains third drain pump 117 which may be activated by controller 23 when it is desired to pump fluid from assembly channel 42 through third drain metering region 114. Third drain pump 117 is preferably designed such that fluid is substantially prevented from flowing in either direction unless third drain pump 117 is activated. A portion of assembly channel 42 extends through the third drain capping layer 116, as shown in FIG. 1*c*, so that a portion of assembly channel 42 passes through the entire third drain layer 110.

In operations to be described, color segment assembly units 40 provide color segments 211 in assembly channels 42, consisting of discreet lengths of one or more fluids selected from among carrier fluid 59, first color ink 69, second color ink 89, and third color ink 109. These color segments can correspond to an image pixel or a portion of an image pixel to be viewed or to be transferred to a receiver.

Figure 2A:
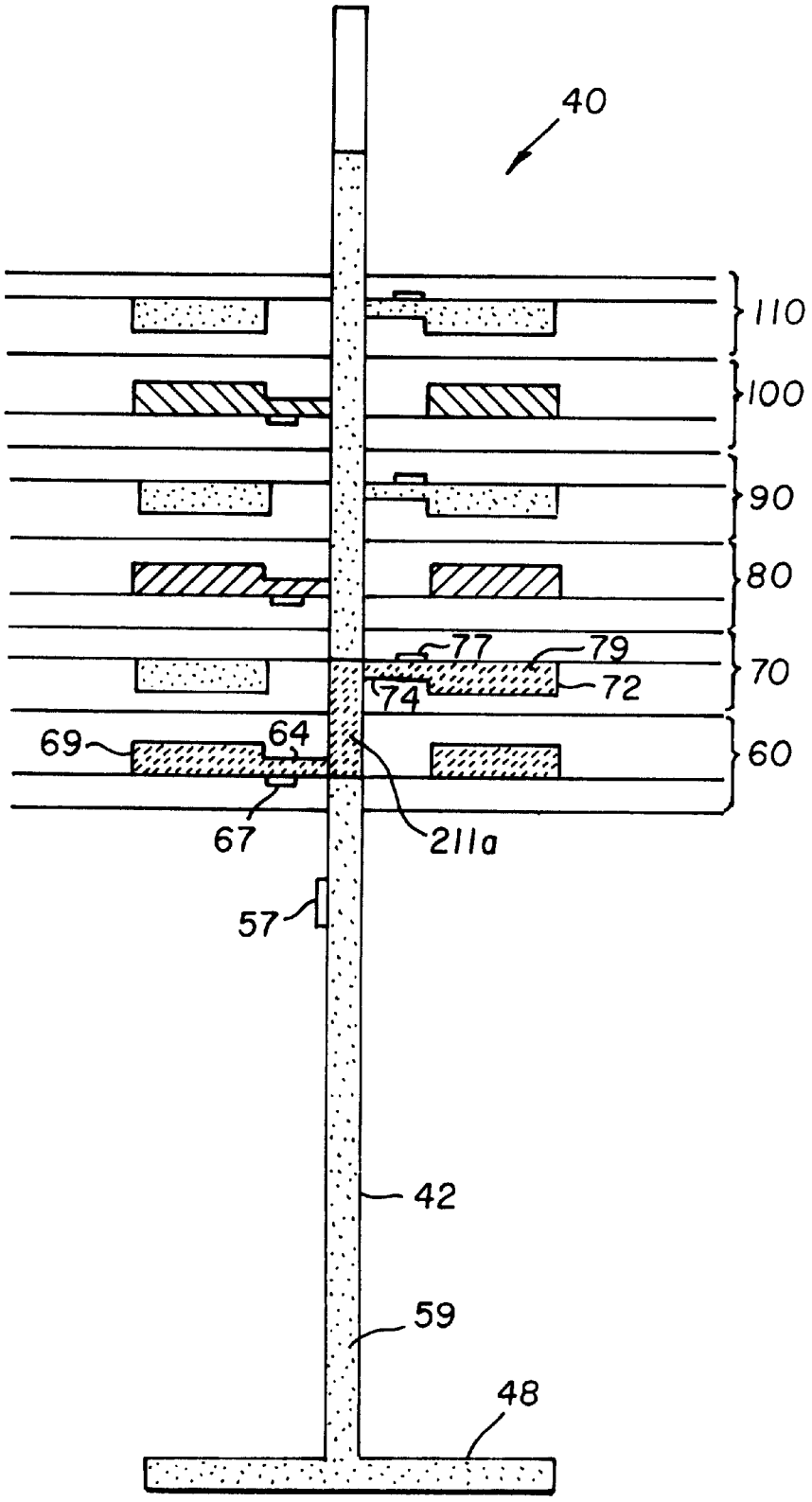
FIG. 2*a*–FIG. 2*f* show various steps in the process of forming a plurality of color segments.

Referring to FIGS. 2*a*–2*f*, color segment assembly unit 40 is shown comprising assembly channel 42 connected to carrier fluid reservoir 48, both filled with carrier fluid 59, and first color source layer 60, first drain layer 70, second color source layer 80, second drain layer 90, third color source layer 100, third drain layer 110, and carrier fluid pump 57, all having parts previously described. FIG. 2 is similar to FIG. 1*c* except that the assembly channel 42 is filled only with carrier fluid 59 in FIG. 1*c*, where as in FIG. 2*a*, depicted after operation of first color pump 67 and first drain pump 77, a segment of assembly channel 42 between first color metering region 64 and first drain metering region 74 is occupied by a first color segment 211*a*. The occupancy of first color segment 211*a* in assembly channel 42 has been accomplished in accordance with this invention by pumping first color ink 69 through first color metering region 64 into assembly channel 42 while simultaneously pumping, at substantially the same rate, fluid (a first collected fluid 79) out of assembly channel 42 into first drain metering region 74, and continuing this pumping at least until a portion of first color ink 69 has been pumped into first drain metering region 74. In this manner, first color segment 211*a* has been formed without substantially disturbing carrier fluid 59 below first color metering region 64 and above first drain metering region 74, as would be anticipated by one skilled in the art of fluid mechanics. The length of first color segment 211*a* in assembly channel 42 remains the same (equal to the distance between first color metering region 64 and first drain metering region 74) for pumping times longer than the time required for first color segment 211*a* to reach first drain metering region 74, because after this time, first color pump 67 and first drain pump 77 act to continuously pump first color ink 69 to first drain reservoir 72. This situation is depicted in FIG. 2*a* by showing the first drain reservoir 72 to be filled with first color ink 69. Therefore, in this case, first collected fluid 79 is principally first color ink 69.

Figure 2B:
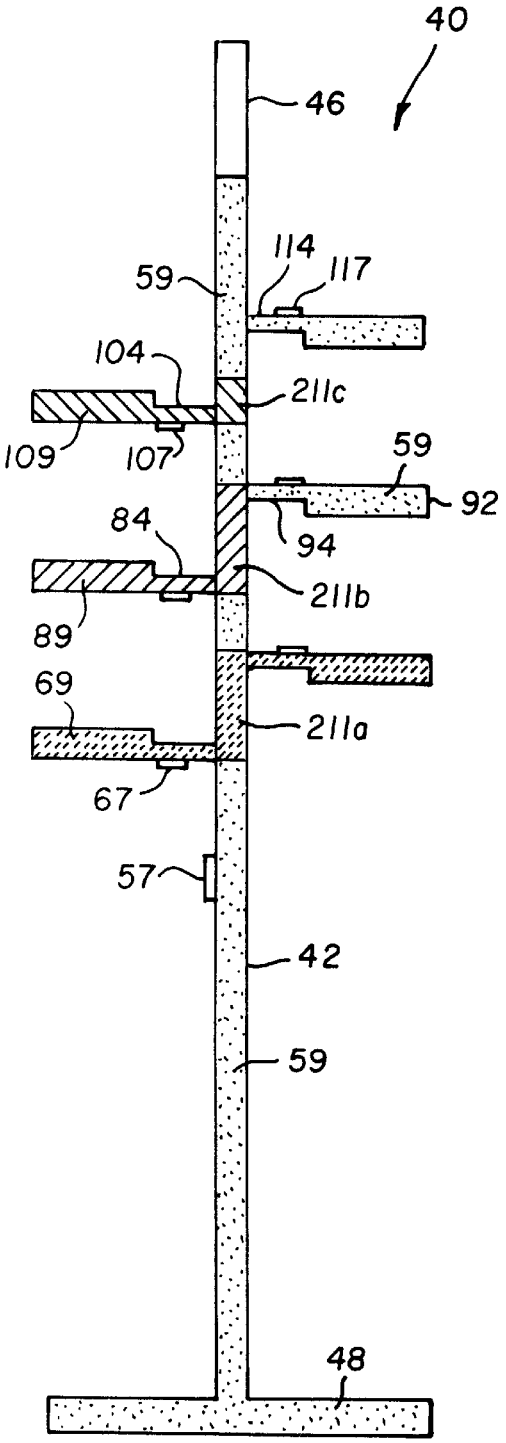

As shown in FIG. 2*b*, the occupancy of a second color segment 211*b* in assembly channel 42 is accomplished in accordance with this invention in a manner similar to that used to provide first color segment 211*a* in assembly channel 42, that is by pumping second color ink 89 through second color metering region 84 into assembly channel 42 while simultaneously pumping, at substantially the same rate, carrier fluid 59 out of assembly channel 42 into second drain metering region 94. FIG. 2*b* depicts a situation in which the pumping of second color ink 89 has been terminated at the time second color segment 211*b* has just reached second drain metering region 94. In this case, second drain reservoir 92 remains primarily filled with carrier fluid 59, and the length of second color segment 211*b* in assembly channel 42 is the distance between second color metering region 84 and second drain metering region 94.

Likewise, occupancy of a third color segment 211*c* in assembly channel 42 is also shown in FIG. 2*b* in accordance with this invention by pumping third color ink 109 through third color metering region 104 into assembly channel 42 while simultaneously pumping, at substantially the same rate, fluid out of assembly channel 42 into third drain metering region 114. However, in the case of the third color ink, color segment 211*c* is shown shorter than the distance between third color metering region 104 and third drain metering region 114, corresponding to situation in which the time during which third color pump 107 and third drain pump 117 act is shorter than the time required for fluid to be pumped the entire distance between third color metering region 104 and third drain metering region 114. The additional distance between third color metering region 104 and third drain metering region 114 in assembly channel 42 is taken up by carrier fluid 59.

It is clear from the principles of operation illustrated in FIG. 2*a* and 2*b*, that first, second, and third color segments 211*a*, 211*b*, and 211*c* respectively have been formed in the region between first color metering region 64 and third drain metering region 114, each color segment being of length equal to or less than the distance between the respective color metering region and drain metering region. In the preferred embodiment, the distance between each of the three color metering regions and their associated drain metering regions is identical, although this need not be the case. It is a feature of this method of providing first, second, and third color segments 211*a*, 211*b*, and 211*c* respectively that the lengths of the color segments depend on the geometry of the color segment assembly units 40 and not on the time of operation of the pumps so that a precise amount of ink of a certain type is provided. It is also to be noted that first, second, and third color segments 211*a*, 211*b*, and 211*c* respectively have been formed in the region between first color metering region 64 and third drain metering region 114 without alteration of the height of carrier fluid 59 in assembly channel top 46.

Figure 2C:
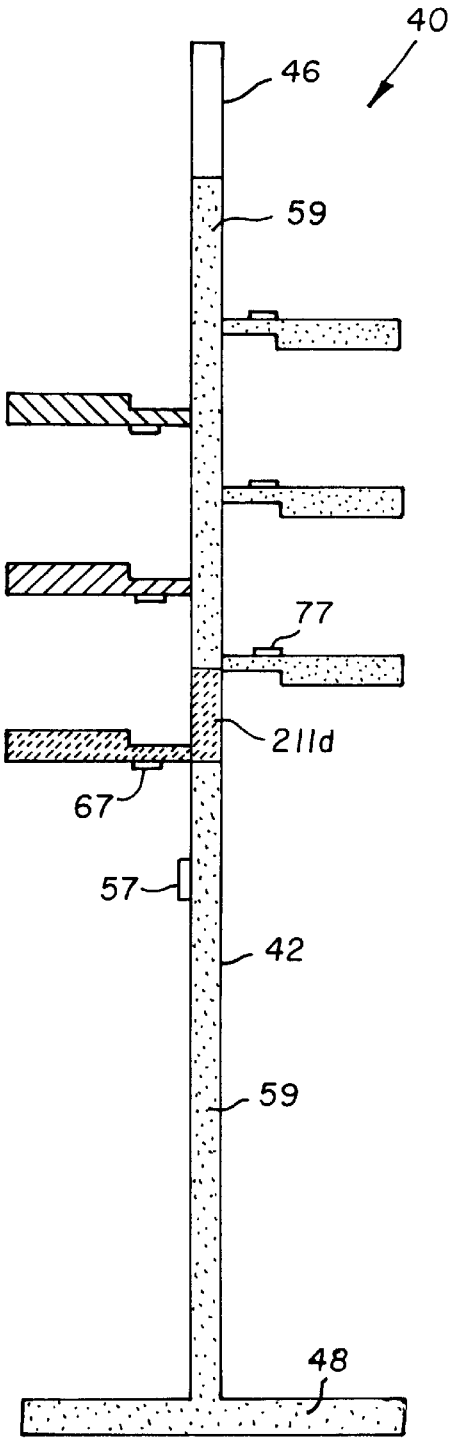
Figure 2D:
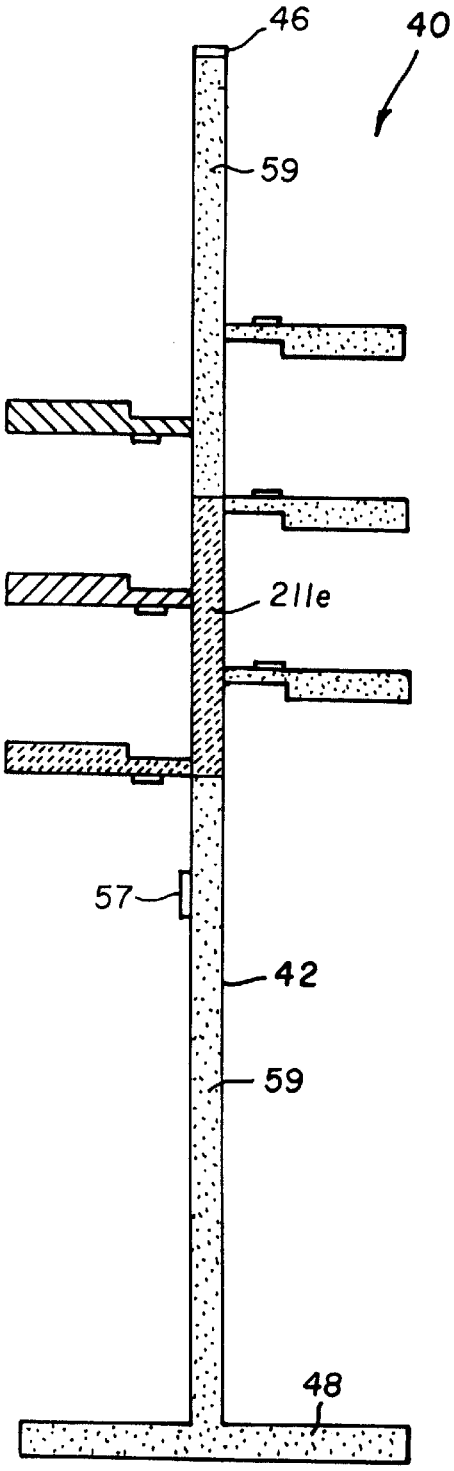
Figure 2E:
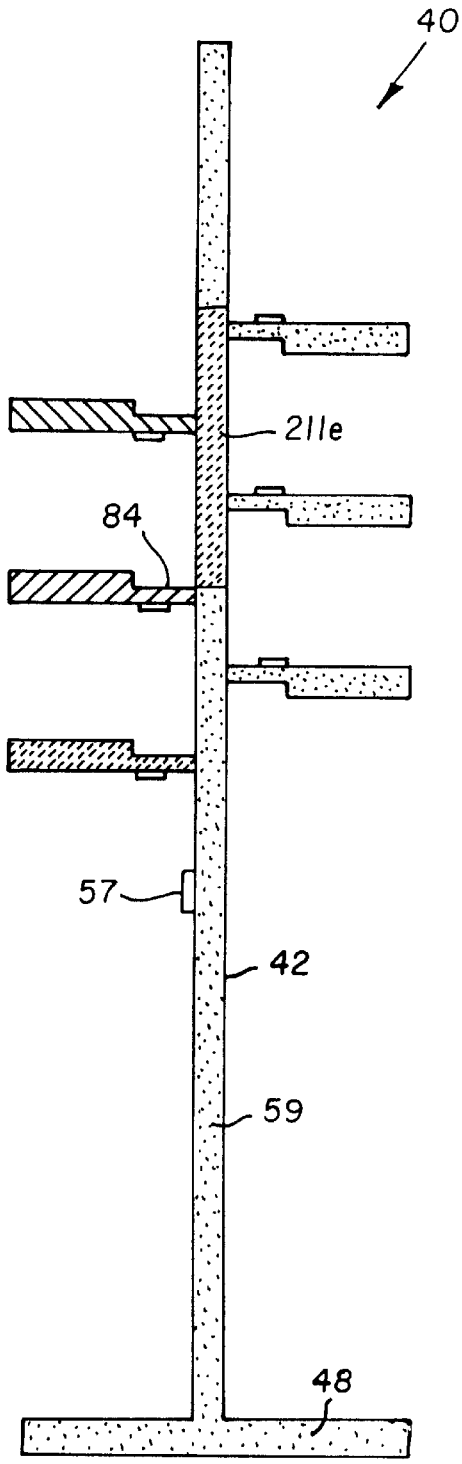
Figure 2F:
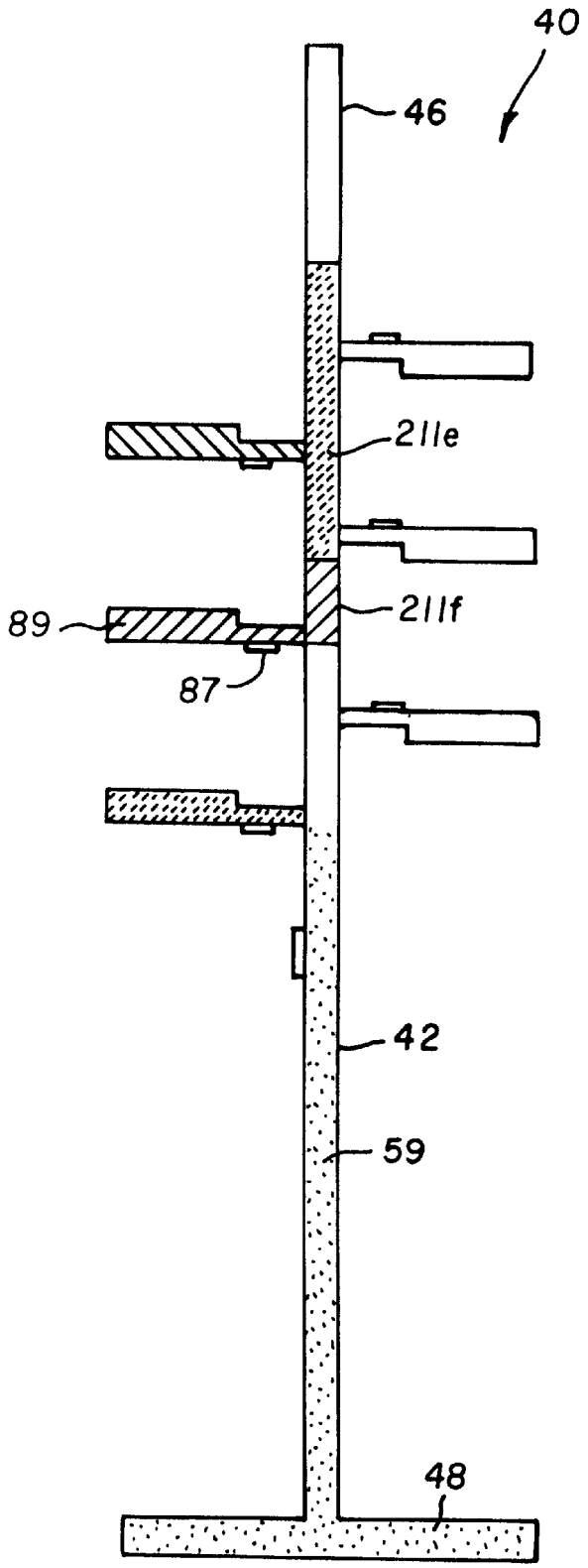

FIG. 2*c* through FIG. 2*f* shows another preferred method of operation of color segment assembly unit 40 in which a first color segment 211*e* is formed which is longer than the distance between first color metering region 64 and first drain metering region 74. In accordance with the first step of this method, FIG. 2*c* shows the formation of a first color segment 211*d* of length equal to the distance between first color metering region 64 and first drain metering region 74, in a manner similar to the formation of second color segment 211*b* described in the previous embodiment. In this step, first color pump 67 and first drain pump 77 have run for equal times at equal rates. In FIG. 2*d*, which shows the second step of the method for forming a first color segment 211*e* longer than the distance between first color metering region 64 and first drain metering region 74, the first drain pump 77 has been turned off while first source pump 67 has remained on, the resulting first color ink 69 having then be forced to flow upward in assembly channel 42. Also as shown in FIG. 2*d*, carrier fluid 59 has increased its height in assembly channel 42 near the assembly channel top 46. As will be described later, in accordance with the operation of color channel array 36 (FIG. 1*b*) in its relationship to color segment assembly array 30, fluid may leave the assembly channel top 46 and flow into color channels 38. It is important to note that the length of color segment 211*e* depends on both the geometry of the color segment assembly channel and the time of operation of various pumps. After forming a first color segment 211*e* (FIG. 2*d*) longer than the distance between first color metering region 64 and first drain metering region 74, it is still possible to form an adjacent color segment of a different color, for example a second color segment 211*f* may be formed, as is shown in FIGS. 2*e* and 2*f* which depict a case in which beginning with the state of the color segment assembly unit 40 shown in FIG. 2*d*, carrier fluid pump 57 has been activated but all other pumps are kept in the off state. In this case, first color segment 211*e* is pumped upward in assembly channel 42 until the bottom of first color segment 211*e* is near the second color metering region 84. At this time, as shown in FIG. 2*f*, second color pump 87 is activated forcing a second color segment 211*f* of second color ink 89 into assembly channel 42 immediately below first color segment 211*e*. The length of second color segment 211*g* depends on the time of operation of the second color pump and may bear any relationship the t distance between second color metering region 84 and first drain metering region 94. Thereby is formed a combination of a first color segment 211*f*, longer than the distance between first color metering region 64 and first drain metering region 74 in close proximity to second color segment 211*g* whose length is arbitrary and dependent on the duration of operation of pumps as well as on the assembly channel geometry. It is important to note that color segments may be formed in vertical stacking order, because carrier fluid pump 57 may pump in either direction. For example, if a second color segment were to be formed in the first step of a color segment assembly operation and it were desired to place a first color segment adjacent to and below the second color segment (the opposite color order of the structure discussed above), then the bottom of the second color segment could be brought into alignment with first color metering region 64 by running carrier fluid pump 57 so as to pump carrier fluid 59 downward.

In a related second embodiment of color assembly units 40 which comprise color segment assembly array 30, only first color source layer 60, second color source layer 80, and third color source layer 100 are employed for pumping fluids, while first drain layer 70, second drain layer 90, and third drain layer 110 are absent. In this related second embodiment, a simplified color assembly unit 40*a* shown in FIGS. 4*a*–4*h* replaces color assembly units 40. Most functions of the present invention can be achieved in this embodiment of color assembly units 40 which is simpler to manufacture. The structure according to this embodiment is also later used for simplicity in figures describing the operation of other aspects of the present invention.

An alternative method of providing a predetermined pattern of color segments is achieved in a simplified color segment assembly unit 40*a*, described in association with FIG. 3 and FIGS. 4*a*–4*h*. Specifically, the operation of color segment assembly array 30 when it is comprised of simplified color assembly units 40*a* rather than color assembly units 40 is described in FIGS. 4*a*–4*h* which illustrates an alternative method by which ink segments 211 are provided.

Figure 3:
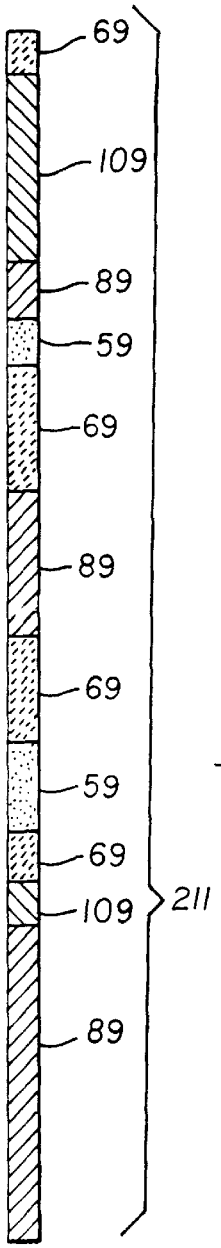
FIG. 3 shows a desired color segment pattern which corresponds to the steps shown in FIGS. 4*a*–FIG. 4*h;*

FIG. 3 represents schematically a pattern of predetermined color segments 211 which is a desired color pattern to be assembled by process operations described below by simplified color assembly unit 40*a*. The colors shown (top to bottom) in desired color pattern 205 of FIG. 3 include the colors of first color ink 69, third color ink 109, second color ink 89, and the color of carrier fluid 59 which is preferably colorless.

Figure 4A:
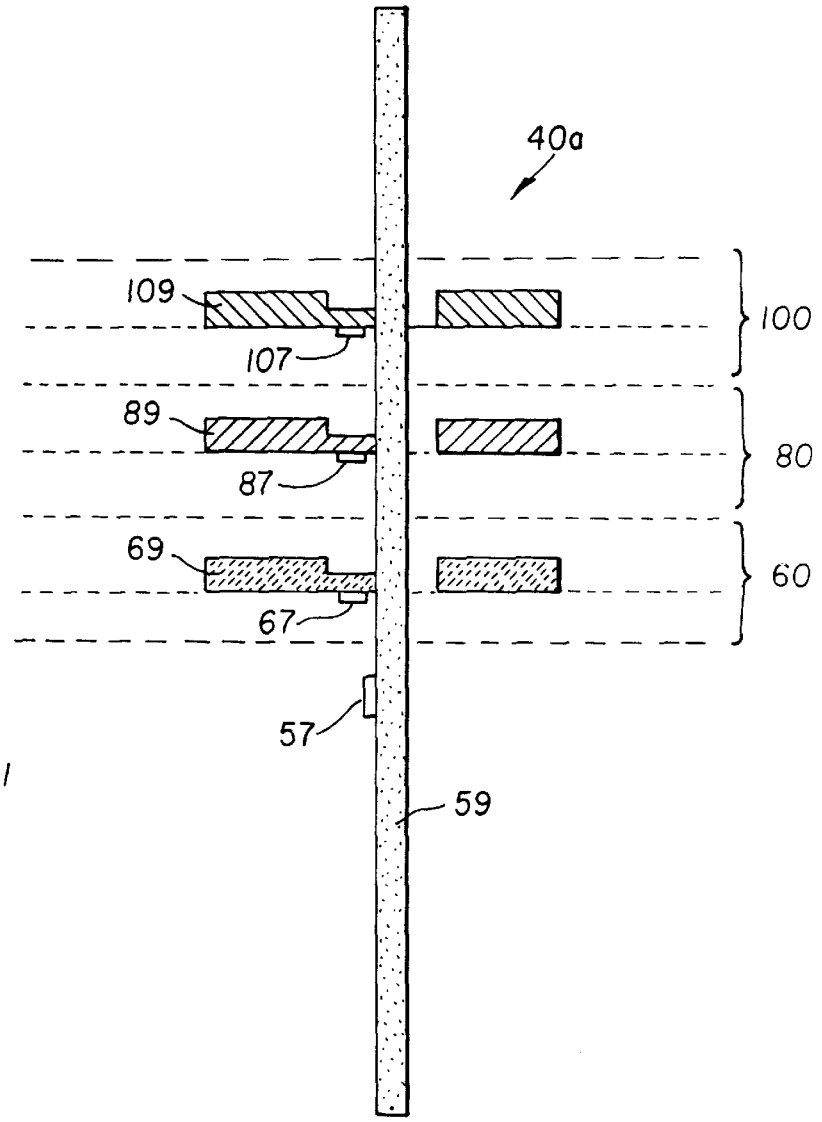
FIG. 4*a*–FIG. 4*h* show various steps in the process of forming a plurality of color segments in a simplified color segment assembly unit.

FIG. 4*a* is a cross-sectional view of simplified color assembly unit 40*a* with assembly channel 42 filled with carrier fluid 59, carrier fluid pump 57, first color source layer 60 filled with first color ink 69, first color pump 67, second color source layer 80 filled with second color ink 89, second color pump 87, third color source layer 100 filled with first color ink 109, and third color pump 107. Predetermined color segments 211 shown in FIG. 3 as desired color pattern 205 are to be assembled in assembly channel 42 using process operations described below, by simplified color assembly unit 40*a*. The colors shown (top to bottom) in desired color pattern 205 include the colors of first color ink 69, second color ink 89, third color ink 109, and the color of carrier fluid 59 which is preferably colorless. FIG. 4*a* corresponds to the beginning of the color segment assembly process.

Figure 4B:
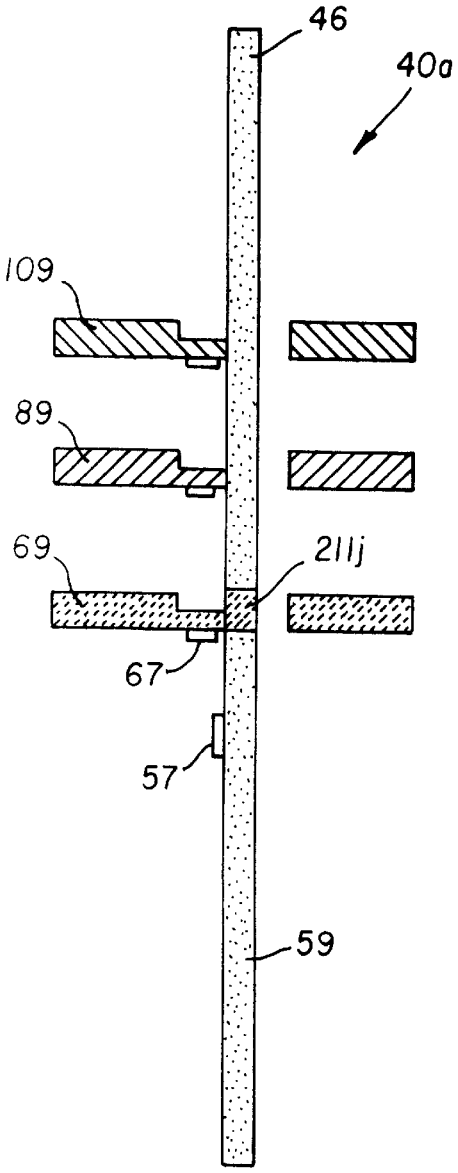

FIG. 4*b* shows the simplified color assembly unit 40*a* after the first step in the assembly of desired color pattern 205. First color segment 211*j* has been pumped into assembly channel 42 by activating first color pump 67. Carrier fluid in the assembly channel top 46 has been pumped upwards in this step. As described later, any fluid flowing out of assembly channel top 46 will flow into color channels 38 connected to assembly channel top 46 (FIG. 1*c*). The length of first color segment 211*j* is controlled by the pump flow rate and the time during which the pump is on so as to be the a predetermined length, namely the length of the color segment shown topmost in desired color pattern 205. This time may be computed by data processor 24 using data from digital imaging source 26 and knowledge of the pump rate of first color pump 67 and the amount of ink in the corresponding color segment of the desired color pattern 205, or the time may be taken from a look up table stored in data processor 24.

Figure 4C:
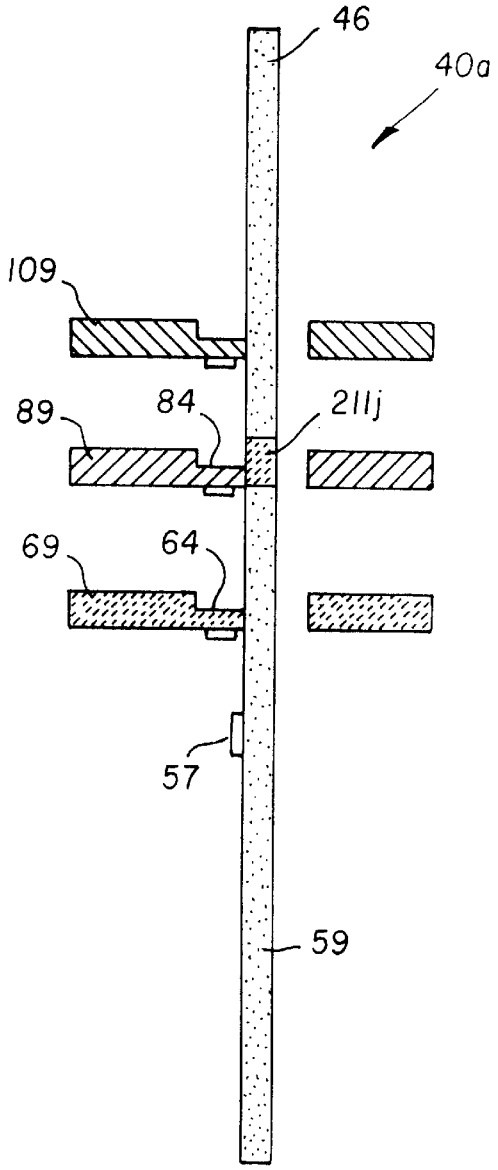

FIG. 4*c* depicts the position of first color segment 211*j* after carrier fluid pump 57 has been activated for a time sufficient to move the bottom of first color segment 211*j* into alignment with second color metering region 84. This time may be computed by data processor 24 from a knowledge of the pump rate of carrier fluid pump 57 and the distance between second color metering region 84 and first color metering region 64 or may be taken from a look up table stored in data processor 24 which receives information about colorant transfer printhead 10 through electrical interconnects 22.

Figure 4D:
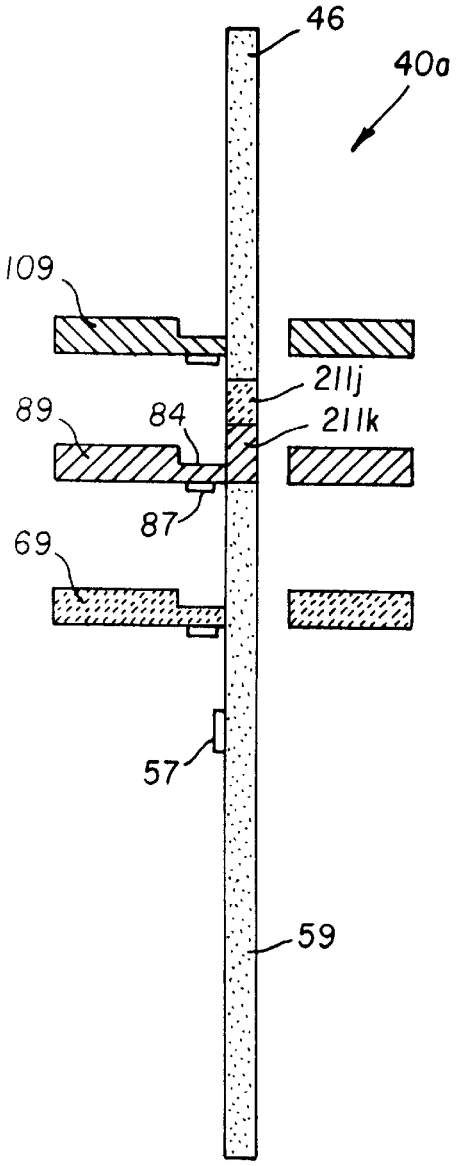

FIG. 4*d* depicts the position of first color segment 211*j* and a second color segment 211*k* after second ink pump 87 has been for a time sufficient to provide a length of second color segment 211*k* equal to the length of the third-from-top color shown in desired color pattern 205 (FIG. 3). This time may be computed from a knowledge of the pump rate of second ink pump 87 and amount of ink in the corresponding color segment of the desired color pattern 205 or the time may be taken from a look up table.

Figure 4E:
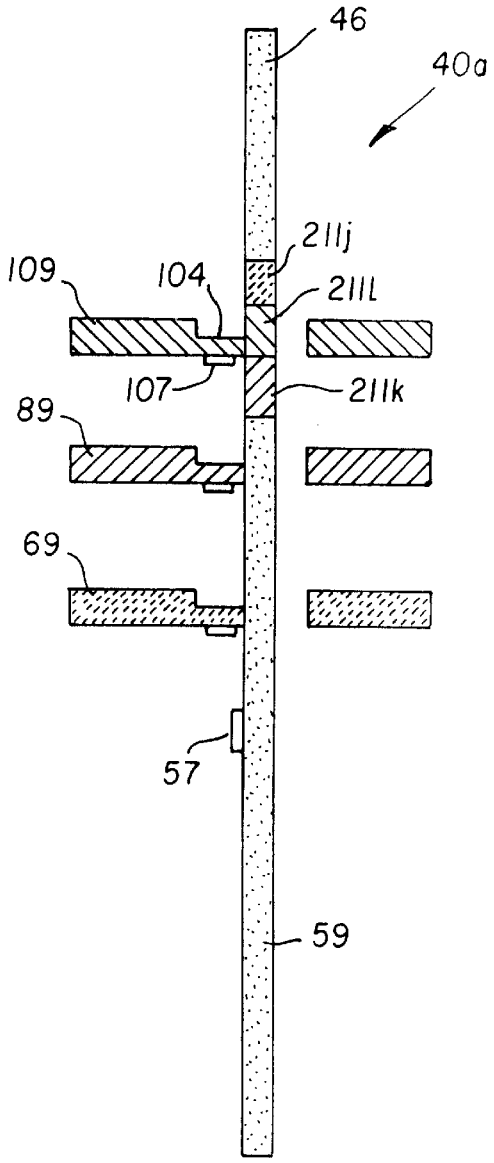

FIG. 4*e* depicts the position of first color segment 211*j*, second color segment 211*k*, and partial third color segment 211*l* after carrier fluid pump 57 has been activated for a time sufficient to move the bottom of first color segment 211*j* into alignment with third color metering region 104 and also after second ink pump 87 has been activated for a time sufficient to provide a length of second color segment 21*k* smaller than the length of the second-from-top color shown in desired color pattern 205 (FIG. 3). In effect, partial third color segment 211*l* has been inserted between first color segment 211*j* and second color segment 211*k*.

Figure 4F:
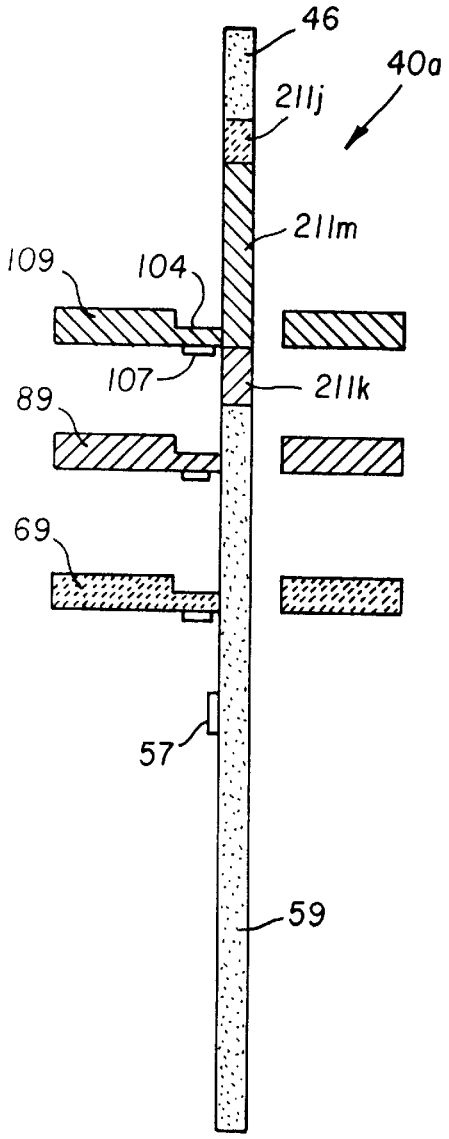

FIG. 4*f* depicts the position of first color segment 211*j*, second color segment 211*k*, and third color segment 211*m* after second ink pump 87 has continued to be activated for a time sufficient to provide a length of partial third color segment 211*l* equal to the length of the second-from-top color shown in desired color pattern 205 (FIG. 3). This time may be computed by data processor 24 from a knowledge of the pump rate of third ink pump 107 and of the amount of ink in the corresponding color segment of the desired color pattern 205, or the time may be taken from a look up table. In effect, third color segment 211*m* has been inserted between first color segment 211*j* and second color segment 211*k* by the steps depicted in FIGS. 4*e* and 4*f*.

Figure 4G:
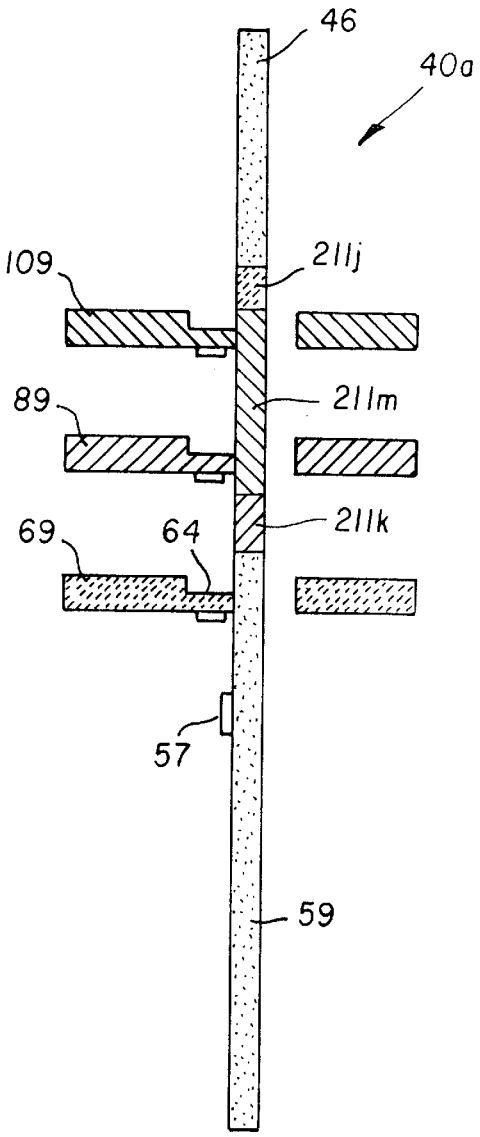

FIG. 4*g* depicts the position of first color segment 211*j*, second color segment 211*k*, third color segment 211*l* after carrier fluid pump 57 has been activated to pump carrier fluid downward in assembly channel 42 for a time sufficient to move the bottom of third color segment 211*m* a distance equal to the length of the corresponding carrier fluid portion (fourth from top in FIG. 3) of desired color pattern 205 above first color metering region 64.

Figure 4H:
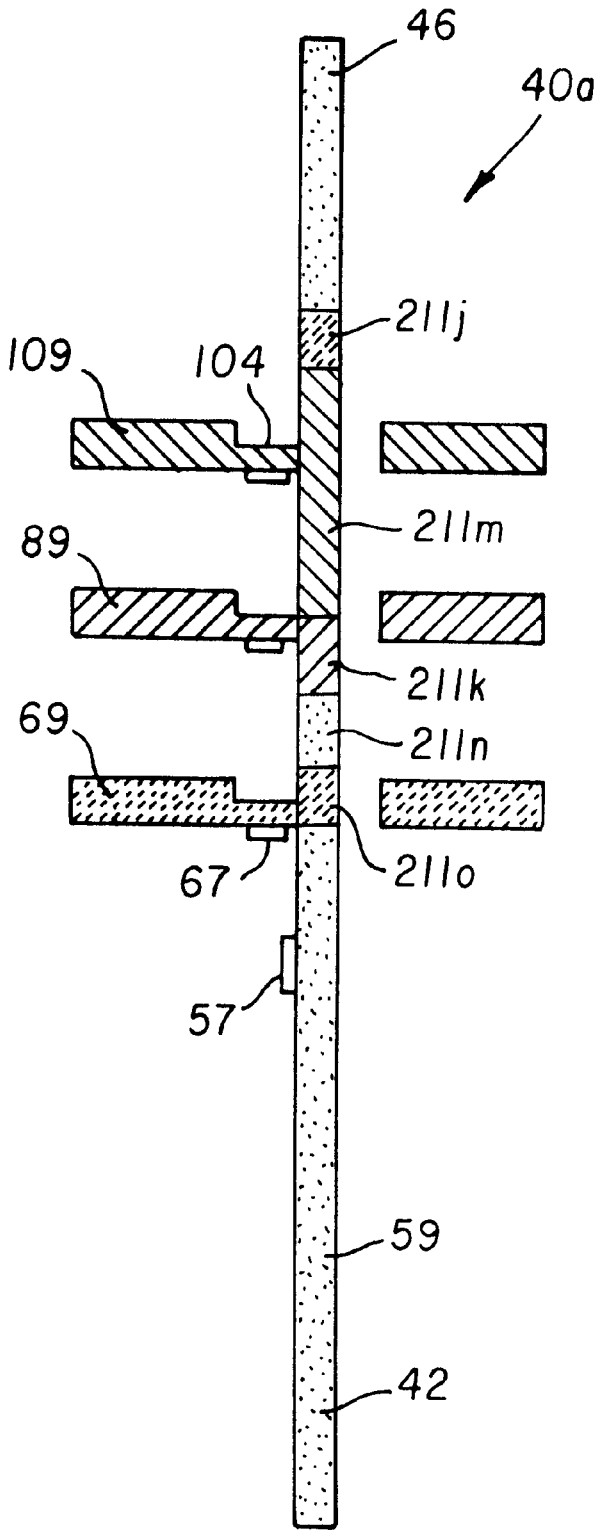

FIG. 4*h* depicts the position of first color segment 211*j*, second color segment 211*k*, and third color segment 211*m*, carrier fluid segment 211*n*, and first color segment 211*o* after first color pump 67 has been activated for a time sufficient to move at least some first color ink 69 upwards along assembly channel 42. Again, the time of pump activation may be computed from know pump rates or taken from a look-up table.

The steps illustrated by FIGS. 4*a* through 4*h* show one representative method in accordance with this invention for operating simplified color segment assembly unit 42*a* to provide a number (in this case four) of predetermined color segments 211 forming part of desired color pattern 205. It is to be appreciated that sequences of similar steps can be used to provide a larger portion or the entire portion of any patterns of predetermined color segments 211. It is also to be appreciated that while the sequence of steps described is adequate to provide the of desired color pattern 205 of color segments 211 shown in FIG. 4*a*, other sequences in which the ordering of some steps is altered can also provide the same pattern.

In accordance with the present invention, colorant transfer printhead 10 is also comprised of color channel array 36 (FIG. 1*b*) which acts to receive color segments 211 assembled in color segment assembly array 30. Color channel array 36 is preferably located on substrate top surface 14 and has a plurality of parts whose geometry and composition are essential to the operation of colorant transfer printhead 10. As shown in FIG. 1*b*, a preferred embodiment of color channel array 36 consists of rectangular color channels 210 formed by etching substrate top surface 14, preferably by a reactive ion etch, each color channel having a fluid input end 212 connected to assembly channel top 46 of an associated color segment assembly unit 40 and a fluid overflow end 214 connected to a single overflow channel 216. It is an object of the present invention that fluids be pumped vertically along assembly channels 42 of color segment assembly array 30 and into the color channels 38 associated with each assembly channel. Fluids so pumped include first color ink 69, second color ink 89, third color ink 109, and carrier fluid 57, and comprise a plurality of color segments 211.

Therefore it is the purpose of color segment assembly array 30, comprised of either color segment assembly units 40 or simplified color segment assembly units 40*a*, to assemble predetermined color segments in assembly channels 42 in accordance with data provided by digital image source 26 and pump said color segments 211 into color channels 38. In particular, when all assembly channels are operated, it is the purpose of either color segment assembly units 40 or simplified color segment assembly units 40*a* (FIG. 1*b* and FIG. 4*a*–4*h*, respectively) to provide a plurality of predetermined color segments 211 in assembly channels 42 and to pump the plurality of color segments 211 into the corresponding plurality of horizontally oriented color channels 38, thereby forming a two-dimensional array of predetermined color segments corresponding to the image in digital image source 26, as is well known in the art of image data processing.

Pumping color segments 211 into the corresponding horizontally oriented color channels 38 occurs when a particular assembly channel 42 of color segment assembly array 30 is operated so as to produce predetermined color segments the sum of whose lengths exceeds the distance from third color metering region 104 (for example in FIG. 4*h*) to assembly channel top 46, because color segments 211 at the top of assembly channels 42 have nowhere else to go than into color channels 38. The rightmost color channel 38 in FIG. 1*b* shows color segments 211 pumped into the fluid input end 212 of color channel 38. Color segments 211 pumped into a single color channel 38 are also shown in cross-section along color channels 38 in FIGS. 5*a*–5*c*, as described below.

Figure 6A:
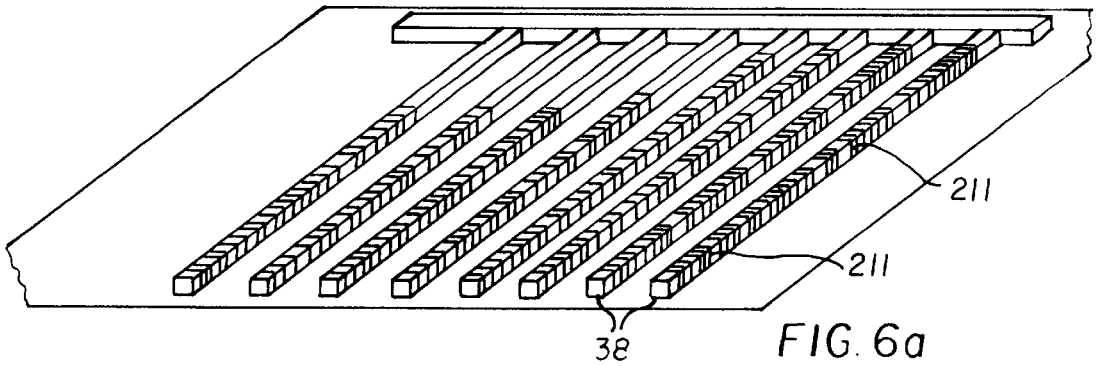
FIG. 6*a* is a schematic perspective of a two-dimensional color channel array for viewing color segments.

By activating carrier fluid pump 57 in the upward direction, any color segments 211 provided in assembly channels 42 can be pumped to any point in horizontally oriented color channels 38. The position of the color segments is controlled by controller 23 so that the color segments 211 at the fluid outflow end 214 of each of color channels 38 corresponds to an edge of an image in the digital image source 26, based on calculations of data processor 24 using the lengths of the assembly channels 42 and the color channels 38 and the pumping rates of first, second, and third fluid pumps 67, 87, and 107 respectively and of carrier fluid pump 57. Thereby is provided a plurality of predetermined color segments 211 color channels 38 which form a two-dimensional array of predetermined color segments corresponding to the image in digital image source 26. A portion of a two-dimensional array of color segments in several color channels is shown schematically in FIG. 6*a*. Neighboring color segments 211 in FIG. 6*a* are assumed to represent different fluids.

There are at least two modes of operation of the colorant transfer printhead 10 in accordance with the present invention, a viewing mode and a printing mode. In the viewing mode a visible color image of the ink segments 211 is made to be observable from either the top or the bottom of colorant transfer printhead 10. In the printing mode, ink segments 211 in color channels 38 are transferred to receiver 230.

Figure 5A:
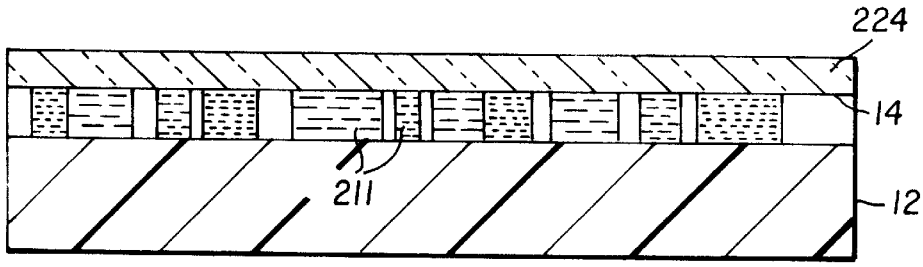
FIG. 5*a*–FIG. 5*c* show cross-sectional views of color segments which may be viewed as an image.
Figure 5B:
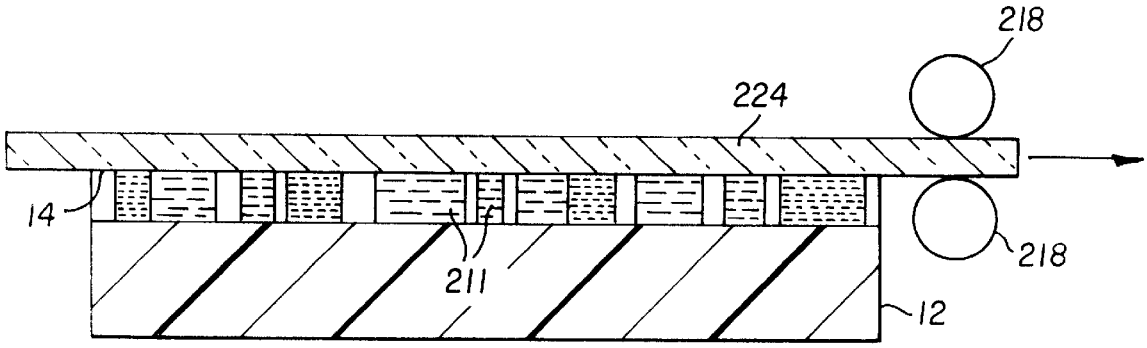
Figure 5C:
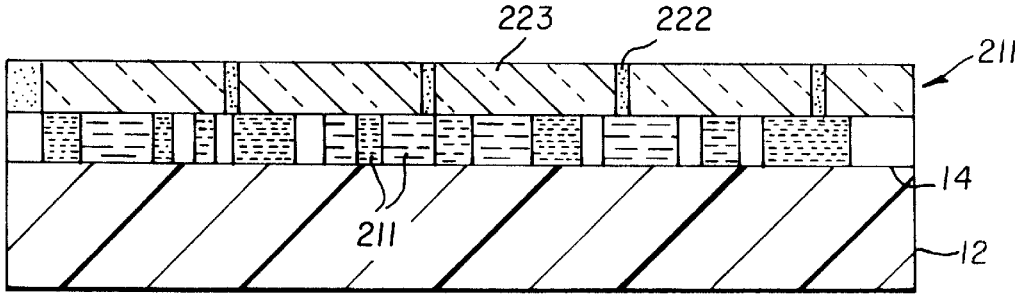

FIG. 5*a* depicts a cross-section along a color channel 38 of FIG. 1*b* showing a cross-section of one color channel 38, useful when the mode of operation of colorant transfer printhead 10 is the image viewing mode, in which a visible color image of the ink segments 211 is made to be observable from either the top or the bottom of colorant transfer printhead 10. A uniform transparent layer 224, such as glass, permanently covers substrate top surface 14. In another embodiment of the present invention useful in the image viewing mode and shown in FIG. 5*b*, uniform transparent layer 224 is moved along the top surface 14 of substrate 12 by rollers 218 preferably in the direction of flow of ink segments 211 in color channels 38 during the time ink segments 211 are pumped into color channels 38. In yet another embodiment of the present invention useful in the image viewing mode as shown in FIG. 5*c*, a partially transparent layer 221 permanently covers substrate top surface 14. Partially transparent layer 221 may consist of segments of a transparent material 223 separated by an opaque material 222. The embodiments shown in FIG. 5*a*–c are useful for viewing the pattern of ink segments in color channels 230 but are not used for printing, due to the need for ink to be flowed to the overlying receiver 230 at a predetermined printing time.

Figure 6B:
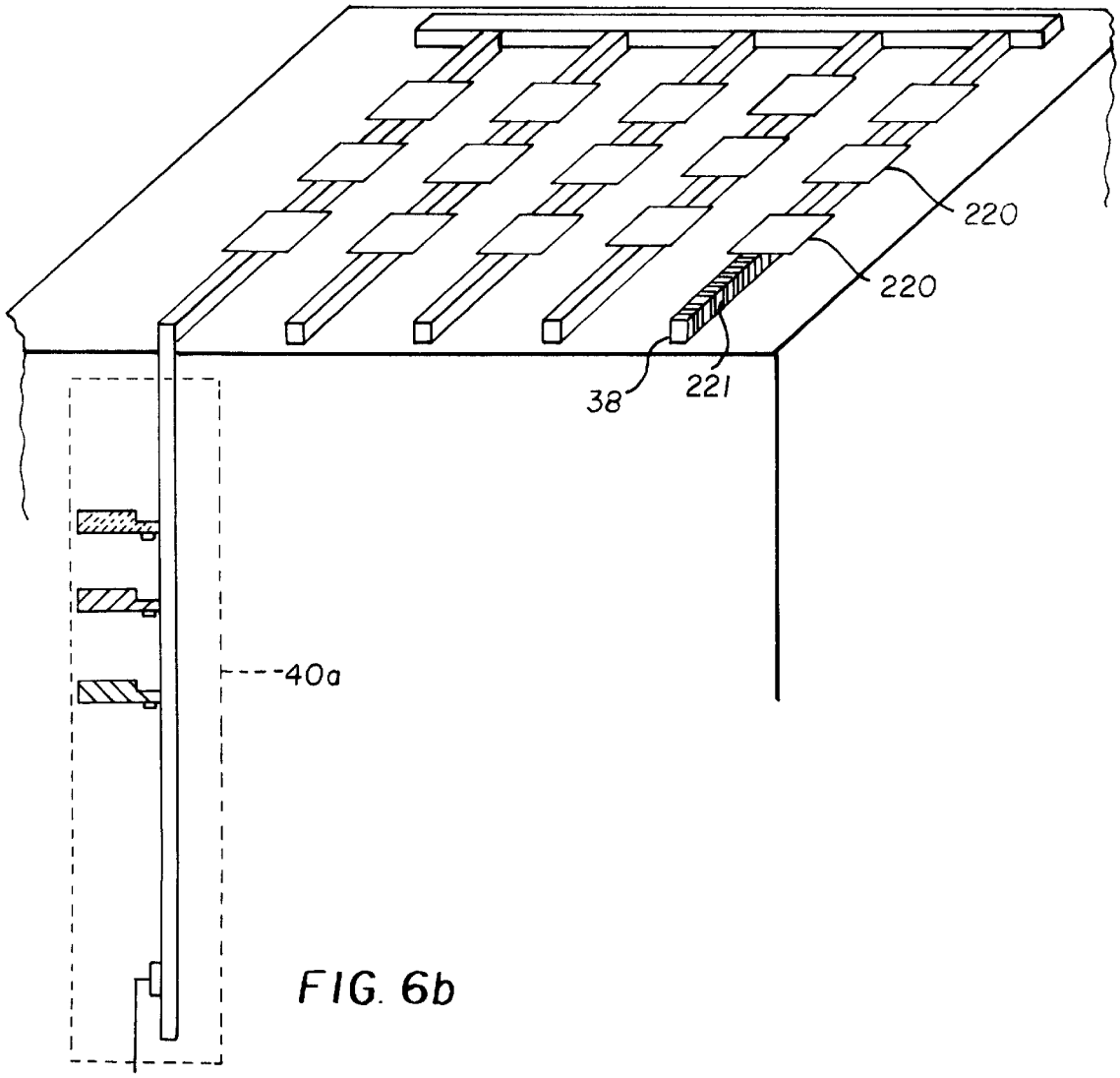
FIG. 6*b* is a schematic perspective of a color channel array with gates for printing color segments on a receiver.

A preferred embodiment of color channel array 36 useful in the image printing mode and shown in FIG. 6*b* consists of color channels 38 formed by etching rectangular grooves into substrate top surface 14, preferably by a reactive ion etch, each color channel having gates 220, shown in FIG. 6*b*, corresponding to physical structures that are used to enable groupings or portions of ink segments 211, shown schematically in the right most color channel 38 of color channel array 36, to be transferred to a receiver 230 (FIG. 7*a*) overlying substrate top surface 14 when it is desired to print an image on receiver 230.

Gates 220 can be of many types, as will be described below, and in each case are characterized by their structure and functionality.

Gates 220 are preferably in the size range of from 10 to 1000 microns in order that a high quality color image can be rendered. Gates 220 serve in printing to enable the transfer of ink segments 211 from color channel array 36 to receiver 230 after a predetermined image transfer time and may therefore be regarded as devices which gather ink from a region including one or more ink segments 211 in one or more color channels 38 and cause such ink to be deposited on receiver 230 during the predetermined image transfer time.

Figure 7A:
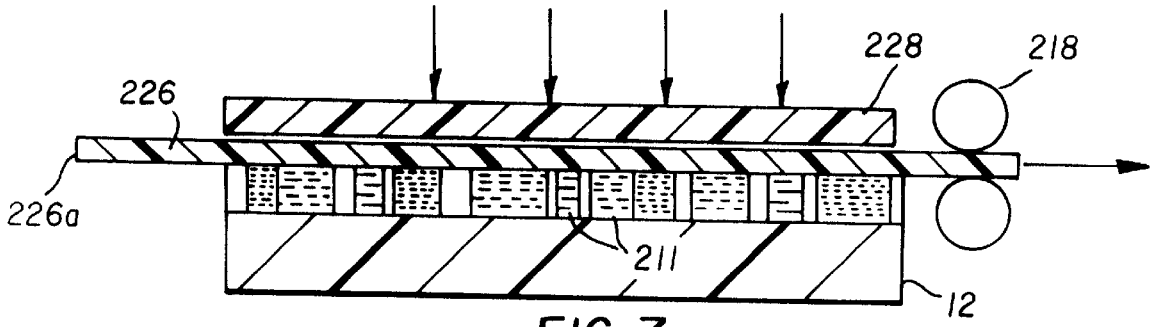
FIG. 7*a*–FIG. 7*c* respectively show a plan view and a cross-sectional view depicting the transfer of color segments to the receiver.
Figure 7B:
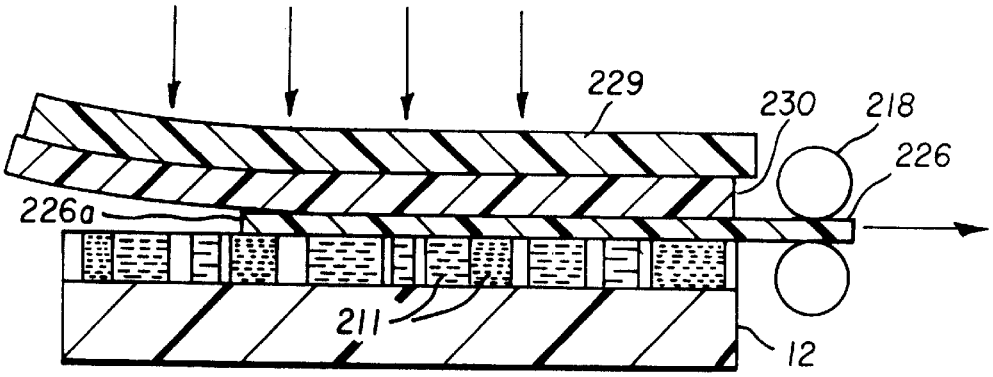
Figure 7C:
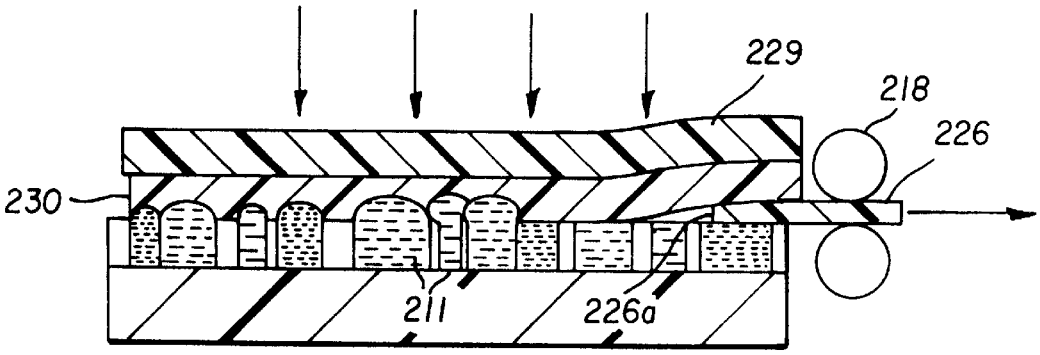

FIGS. 7*a*–7*c* depict cross-sections of FIG. 6 along a color channel showing a cross-section of one color channel 38 having ink segments 211 having a particularly simple type of pixel gate 220 useful when the mode of operation of colorant transfer printhead 10 is the printing mode, in which a visible color image of the ink segments 211 is transferred to receiver 230. The gates 220 according to this embodiment are provided by a thin membrane 226, which is held flat on substrate top surface 14 by pressure plate 228 during the time when ink segments 211 are pumped along color channels 38 and is then later removed so as to permit contact of receiver 230 and ink segments 211 as will be described. Alternatively, thin membrane 226 can be moved along the top surface 14 of substrate 12 by rollers 218 preferably in the direction of flow of ink segments 211 in color channels 38 during the time ink segments 211 are pumped into color channels 38 to assist pumping. In this case thin membrane 226 is initially longer than color channel 38 so that membrane edge 226 *a* does not move over color channels 38. Next, during printing, as shown in FIGS. 7*b* and 7*c*, receiver 230 is positioned directly above substrate top surface 14 by pressure plate 229 and is then pressed into contact with thin membrane 226. Printing is initiated by mechanically pulling thin membrane 226 by rollers 218 from one edge until the opposite edge, membrane edge 226 *a* of thin membrane 226, is moved entirely along color channels 38 thereby permitting receiver 230 to be pressed into the top of the color channels 38 along their full length (FIG. 7*c*). Upon contacting the ink segments, inks comprising first, second, and third color inks 69, 89, and 109 respectively and carrier fluid 59 are imbibed into receiver 230. Depending on the diffusivity of first, second, and third color inks 69, 89, and 109 respectively and carrier fluid 59 in receiver 230 and the miscibility of the fluids, color segments 211 my remain substantially separated in receiver 230 or may mix together in receiver 230 as is well known in the art of liquid ink printing. In this embodiment of the present invention, if thin membrane 226 is chosen to be a transparent material such as mylar or estar polymers, the color segments may be viewed prior to printing. Many materials including transparent materials may be used for thin membrane 226, as is well known in the art of polymer thin films.

It is to be appreciated that although the current invention has been described in terms of specific preferred embodiments, there are many other embodiments which are possible and obvious to one skilled in the art that encompass equally the scope and spirit of the invention.

PARTS LIST

| | |
|---|---|
| 10 | colorant transfer printhead |
| 12 | substrate |
| 14 | substrate top surface |
| 20 | fluid supply channels |
| 21 | fluid supply |
| 22 | electrical interconnects |
| 23 | controller |
| 24 | data processor |
| 26 | digital image source |
| 28 | receiver positioning device |
| 30 | color segment assembly array |
| 36 | color channel array |
| 38 | color channel |
| 40 | color segment assembly unit |
| 40a | simplified color segment assembly unit |
| 42 | assembly channel |
| 44 | assembly channel bottom |
| 46 | assembly channel top |
| 48 | carrier fluid reservoir |
| 57 | carrier fluid pump |
| 59 | carrier fluid |
| 60 | first color source layer |
| 61 | first color reservoir layer |
| 62 | first color reservoir |
| 63 | first color external supply |
| 64 | first color metering region |
| 66 | first color capping layer |
| 67 | first color pump |

-continued

PARTS LIST

| | |
|---|---|
| 69 | first color ink |
| 70 | first drain layer |
| 71 | first drain reservoir layer |
| 72 | first drain reservoir |
| 73 | first external drain |
| 74 | first drain metering region |
| 76 | first drain capping layer |
| 77 | first drain pump |
| 79 | first collected fluid |
| 80 | second color source layer |
| 81 | second color reservoir layer |
| 82 | second color reservoir |
| 83 | second color external supply |
| 84 | second color metering region |
| 86 | second color capping layer |
| 87 | second color pump |
| 89 | second color ink |
| 90 | second drain layer |
| 91 | second drain reservoir layer |
| 92 | second drain reservoir |
| 93 | second external drain |
| 94 | second drain metering region |
| 96 | second drain capping layer |
| 97 | second drain pump |
| 99 | second collected fluid |
| 100 | third color source layer |
| 101 | third color reservoir layer |
| 102 | third color reservoir |
| 103 | third color external supply |
| 104 | third color metering region |
| 106 | third color capping layer |
| 107 | third color pump |
| 109 | third color ink |
| 110 | third drain layer |
| 111 | third drain reservoir layer |
| 112 | third drain reservoir |
| 113 | third external drain |
| 114 | third drain metering region |
| 116 | third drain capping layer |
| 117 | third drain pump |
| 119 | third collected fluid |
| 205 | desired color pattern |
| 211 | color segment |
| 211a | first color segment |
| 211b | second color segment |
| 211c | third color segment |
| 211d | first color segment |
| 211e | first color segment |
| 211f | second color segment |
| 211j | first color segment |
| 211k | second color segment |
| 211l | partial third color segment |
| 211m | third color segment |
| 211n | carrier fluid segment |
| 211o | first color segment |
| 213 | predetermined color segments |
| 212 | fluid input end |
| 214 | fluid outflow end |
| 216 | overflow channel |
| 220 | gates |
| 221 | partially transparent layer |
| 222 | opaque material |
| 223 | transparent material |
| 226 | thin membrane |
| 230 | receiver |

What is claimed is:

1. A colorant transfer printhead for viewing or delivering a plurality of color segments onto a receiver comprising:

(a) a color channel array defining a plurality of spaced apart color channels for delivering said plurality of color segments to the receiver, each such spaced apart color channel delivering said plurality of color segments having different colorants to the receiver; and (b) a color segment assembly array which includes means defining a plurality of assembly channels each corresponding to a particular color channel of said plurality of color channels, a plurality of color source layers and color pumps for delivering different colorants to each assembly channel for forming said plurality color segments of different colorants in each assembly channel and means for delivering said plurality of color segments to the color channels so that the color channels each deliver said plurality of color segments having different colorants to the receiver.

2. The colorant transfer printhead of claim 1 wherein the color source layers include at least four different color reservoir layers with one of such layers having a carrier fluid.

3. The colorant transfer printhead of claim 2 further including means including a plurality of color pumps each of which cooperates with a particular color source layer to deliver a predetermined amount of colorant to its corresponding assembly channel, wherein each such predetermined amount is a color segment of said plurality of color segments.

4. The colorant transfer printhead of claim 3 wherein three of the colorants are cyan, magenta, and yellow inks.

5. The colorant transfer printhead of claim 3 wherein the assembly channels are disposed vertically and the color channel array are disposed horizontally so that the assembly channel array and the color channel array are in orthogonal planes.

6. The colorant transfer printhead of claim 3 wherein each color pump produces said plurality of color segments each of which is transferred to different locations on the receiver.

7. The colorant transfer printhead of claim 2 wherein the assembly channels are substantially filled with the carrier fluid prior to the transfer of the color segments to such assembly channels.

8. The colorant transfer printhead of claim 2 wherein each color segment said plurality of color segments includes colored ink and carrier fluid in amounts selected to vary the color intensity and hue when the segment is transferred to the receiver.

9. The colorant transfer printhead of claim 1 wherein the color channels of the color channel array includes said plurality of color segments which correspond to an image.

10. A colorant transfer printhead for viewing or delivering a plurality of color segments corresponding to an image onto a receiver comprising:

(a) a color channel array defining a plurality of spaced apart color channels for delivering said plurality of color segments to the receiver, each such spaced apart color channel delivering said plurality of color segments having different colorants to different predetermined final locations on the receiver, each color channel operating so that said plurality of color segments, enroute to their predetermined final locations, move past the predetermined final locations of other color segments; and (b) a color segment assembly array which includes means defining a plurality of assembly channels each corresponding to a particular color channel said plurality of color channels, a plurality of color source layers and color pumps for delivering different colorants to each assembly channel for forming said plurality of color segments of different colorants in each assembly channel and means for delivering said plurality of color segments to the color channels so that the color channels each deliver said plurality of color segments having different colorants to the receiver.

* * * * *